US006834778B2

(12) United States Patent
Jinbo et al.

(10) Patent No.: US 6,834,778 B2
(45) Date of Patent: Dec. 28, 2004

(54) MIXING AND DISCHARGE DEVICE

(75) Inventors: Keiji Jinbo, Odawara (JP); Tomomi Hamada, Tokyo (JP); Keiko Ishikawa, Tokyo (JP); Yoshie Aoki, Tokyo (JP); Yoshiyuki Kakuta, Tokyo (JP); Toru Toma, Tokyo (JP)

(73) Assignees: Kanebo, Limited, Tokyo (JP); Yoshino Kogyosho Co., Ltd., Tokyo (JP)

( * ) Notice: Subject to any disclaimer, the term of this patent is extended or adjusted under 35 U.S.C. 154(b) by 10 days.

(21) Appl. No.: 10/718,800

(22) Filed: Nov. 24, 2003

(65) Prior Publication Data

US 2004/0134931 A1 Jul. 15, 2004

Related U.S. Application Data

(63) Continuation of application No. PCT/JP02/00753, filed on Jan. 31, 2002.

(30) Foreign Application Priority Data

Jun. 27, 2001 (JP) ..... 2001-193906
Jun. 27, 2001 (JP) ..... 2001-193907
Sep. 28, 2001 (JP) ..... 2001-304104
Sep. 28, 2001 (JP) ..... 2001-304105

(51) Int. Cl.[7] ..... B65D 83/20

(52) U.S. Cl. ..... 222/135; 222/145.5; 222/145.6; 222/402.13; 222/39; 401/47; 401/190; 132/112

(58) Field of Search ..... 222/39, 135, 145.1, 222/145.5, 145.6; 401/44, 47, 190; 132/112, 113, 114, 208

(56) References Cited

U.S. PATENT DOCUMENTS 3,236,418 A * 2/1966 Dalle et al. ..... 222/135
3,236,457 A * 2/1966 Ladd et al. ..... 222/135
3,303,970 A * 2/1967 Breslau et al. ..... 222/134
3,575,319 A * 4/1971 Safianoff ..... 222/135
4,773,562 A * 9/1988 Gueret ..... 222/135
4,792,062 A * 12/1988 Goncalves ..... 222/135
4,826,048 A * 5/1989 Skorka et al. ..... 222/135
4,880,143 A * 11/1989 Murray et al. ..... 222/135
5,169,029 A * 12/1992 Behar et al. ..... 222/135
5,901,883 A * 5/1999 Ritsche ..... 222/145.1
5,924,599 A * 7/1999 Brown ..... 222/135
6,305,578 B1 * 10/2001 Hildebrandt et al. ..... 222/135
6,722,532 B2 * 4/2004 Lasserre et al. ..... 222/402.13

* cited by examiner

*Primary Examiner*—Kenneth Bomberg
(74) *Attorney, Agent, or Firm*—Oliff & Berridge, PLC

(57) ABSTRACT

A mixing and discharge device is provided, in which contents are ejected from a pair of containers (33) standing next to each other and are mixed and discharged outside of this device, by pressing down the discharge nozzles (35) of said containers simultaneously with the manipulation of the thumb and a finger of the hand holding the containers. Said mixing and discharge device comprises an attachment (26) to be fitted firmly around the top portion of the pair of said containers (33), with respective discharge nozzles (35) of the containers coming out of this attachment (26); and a cap unit (8) to be fitted detachably to the discharge nozzles (35) and provided with a passage block (17), which comprises a pair of step holes (23) disposed in the areas near both sides, and into which the discharge nozzles (35) are fitted tightly from underside, a discharge cylinder (19) disposed at the center and on top of this cap unit (8) to form a discharge port, and discharge passages (21) for connecting this discharge port with the step holes (23), wherein an actuating mechanism, with which to act a force to pull down the cap unit (8) by the depressive operation of the manipulating plates (55) in the lateral direction, is formed between a pair of manipulating plates (55) hanging down from either one of the attachment (26) or the cap unit (8) and the portions facing these manipulating plates (55) disposed on the other one of the attachment (26) or the cap unit (8). In this configuration, the portions with which to depress the discharge nozzles could have been displaced downward simply and stably. It has also been made possible to wash away the contents remaining in the discharge passage components.

18 Claims, 24 Drawing Sheets

MIXING AND DISCHARGE DEVICE

This is a Continuation of International Application No. PCT/JP02/00753 filed Jan. 31, 2002. The entire disclosure of the prior application is hereby incorporated by reference herein in its entirety.

TECHNICAL FIELD

This invention relates to a mixing and discharge device that can simultaneously eject the contents out of a pair of containers, each equipped with a discharge nozzle, and can discharge both contents together.

BACKGROUND OF THE INVENTION

Official gazette of Japanese Patent Application (OPI) No. 102569/1992 disclosed a device of the type that discharges together two liquid chemicals, such as certain hair dye components. The aerosol containers contain the two liquid chemicals separately, and when in use, the device ejects the contents, i.e., the chemical agents, simultaneously from a pair of aerosol containers, discharges the mixed chemical agents together through a common hole, and applies the mixture onto hair of the head by means of a brush.

This device based on the prior-art technology comprises a pair of aerosol containers containing liquid chemicals; a bottomed container case for housing the two aerosol containers in a side-by-side position; a guide member equipped with two step holes, which are connected by a hinge in a manner that closes the top opening of this container case and into which the discharge nozzles of respective aerosol containers bump and are fitted from underside, a discharge port on the top surface, and passages for connecting the discharge port with both step holes; and a movable cover equipped with a depressible lever, which is suspended on the front side of the container case.

In this prior art, a depressible lever is pressed toward the container case with fingers of the hand holding the containers, and thereby the guide member is moved downward and tilted, with the hinged connection working as the axis. This movement makes the discharge nozzles on the pair of the aerosol containers depressed and opened simultaneously, and enables both liquid chemicals inside the aerosol containers to be sent through the step holes and the passages and discharged outside together through the discharge port. Thus, this prior art is highly effective because a simple depressing operation of a depressible lever allows the contents of the two aerosol containers to be discharged together simultaneously, in the integrally blended state in which they are useful, and to be applied by means of a brush.

However, this prior-art technology requires that a hinge connects the container case with the movable cover having the discharge port. The fitting structure is not simple, and there is a difference in the extent to which the discharge nozzles of respective aerosol containers are depressed because these discharge nozzles are opened by pressing down and tilting the movable cover through the action of the depressing force that is biased to one side. For this reason, this prior art has a problem in that there is a difference in the volumes of the contents discharged from the two aerosol containers and that the user may use the contents at an improper ratio, without recognizing this imbalance.

Similarly, because pressing down and tilting the movable cover opens the discharge nozzles of the aerosol containers, there was another problem in that it is difficult to secure the seal between the discharge nozzles and the step holes in the movable cover.

Furthermore, the depressible lever has a hard structure that does not undergo deflective deformation. Thus, the prior art has still another problem in that, since the hard depressible lever is located at a projected position in front of the containers, this projected lever disturbs the handling and storage of the containers.

Because of this hinge, the brush and the entire passages for discharging the contents cannot be separated easily from the attachment to the containers provided with discharge nozzles. Therefore, a problem arose in that the entire discharge passages and the brush could not be cleaned for the convenience of repeated use.

The discharge passage components comprise a movable cover and a guide member. From the configuration shown in the drawings, it is not considered easy to separate these two parts. Rather, it seems that the movable cover and the guide member are fixed to each other to obtain reliable sealing ability. Thus, the prior art had another problem in that even if the discharge passage components are separated from the attachment to the containers provided with discharge nozzles, it is hardly possible to clean the inside of the passages.

This invention has been made to solve the above-described problems found in prior art. A technical problem of this invention is that the device of this invention has a configuration ensuring that the portions with which to depress the discharge nozzles of aerosol containers, the containers of the pumping type, and the like, are pulled right downward by the operation of these portions with fingers of the hand holding the containers. Another technical problem of this invention is that the mixing and discharge device has a configuration that enables the components of the device to be easily disassembled. An object of this invention is thus to obtain a mixing and discharge device that can be used always properly and cleaned.

Still another technical problem is that the portions with which to depress the discharge nozzles can be displaced downward simply and stably. Another object of this invention is to obtain a mixing and discharge device that gives a stabilized posture to the portion for discharging the contents, secures strong, stable sealing performance, and has good, safe handling ability.

Still another technical problem of this invention is to give the device of this invention a structure capable of exposing the brush and the entire passages for discharging the contents from the containers of the aerosol type and the pumping type, provided with discharge nozzles. Still another object of this invention is thus to obtain a mixing and discharge device that enables the remaining contents to be fully washed away from the brush and the entire discharge passage components.

In an embodiment of the invention, the device comprises:

- a pair of containers standing next to each other and respectively provided with a discharge nozzle having an open/close function;
- an attachment, which is fitted firmly around the top portions of said containers and which comprises an elliptic cylinder to be fitted tightly around the top portions of the bodies of said pair of containers, a top inward brim disposed on the top edge of the elliptic cylinder, and an opening from which the discharge nozzles come out; and
- a cap unit to be fitted detachably to the discharge nozzles and provided with a passage block, which comprises a pair of step holes disposed in the areas near both sides, into which the discharge nozzles are fitted tightly from underside, a discharge cylinder disposed at the center and on top of this unit to form a discharge port, and discharge passages for connecting this discharge port with the step holes, wherein said mixing and discharge device also comprises: a pair of hanging plates (51) that comes out of the central, front and rear portions of the passage block (17) and hangs down on the front and rear walls of the elliptic cylinder (27); a pair of manipulating plates (55) extending from the lower end of either one of said hanging plates (51) or the elliptic cylinder (27); descendible projections (16), which are provided respectively with a guide slope **(16*a*) and disposed on the manipulating plates (55) at positions opposite to valley-shaped portions that are formed in abutment with the bodies of said pair of containers (33), with the tip of the guide slope (16*a*) being set at a height under the lower end of said elliptic cylinder (27); and a pair of edges of contact (57) disposed at the other one of the hanging plates (51) or the elliptic cylinder (27) at positions opposite to said guide slopes (16*a*), and wherein a force to pull down the cap unit (8) is actuated by depressing said manipulating plates (55) in the lateral direction and sliding said guide slopes (16*a*) over the edges of contact (57)**.

In a configuration of the invention, the assembly of the mixing and discharge device is completed by fitting the attachment firmly around the top portion of a pair of the containers disposed next to each other and then fitting the cap unit to this attachment in a posture of straddling the attachment. The discharge nozzles have come out of the opening surrounded by the top inward brim of the elliptic cylinder, but with the fitting of the cap unit, the nozzles are tightly fitted into the step holes of the cap unit. A pair of manipulating plates extends from the lower end of either the hanging plates or the elliptic cylinder and is provided with a pair of descendible projections. The edges of contact are disposed at the other one of the hanging plates or the elliptic cylinder, and come in contact with the respective guide slopes on the descendible projections.

In this state, the pair of manipulating plates is located on the front and rear of the mixing and discharge device. When the manipulating plates are depressed in the lateral direction with the thumb and the index finger of the hand holding the device, the cap unit is pulled down, along with the passage block, relative to the position of both containers, due to the action of the guide slopes on the descendible projections, which come in contact with the edges of contact. As a result, the discharge nozzles of both containers are depressed equally.

The descendible projections on the manipulating plates are contacted with the edges of contact in a simple mechanism. The depression of the manipulating plates in the lateral direction is definitely converted to the vertical movement of the manipulating plates when the edges of contact come in contact with the guide slopes, which slide obliquely upward or downward. Thus, the depression and vertical movement of the manipulating plates enable a force to act on the cap unit so as to pull down the cap unit relative to the position of the containers.

When the discharge nozzles are depressed, the contents are ejected from both containers. The ejected materials come out of the step holes, go through the respective passages, join together, and are discharged outside from the discharge device.

The depression of the discharge nozzles or the lowering of the passage block of the cap unit is accomplished by pulling down both hanging plates relative to the positions of the containers and the attachment. Since the hanging plates are suspended from the central, front and rear portions of the passage block, these plates are pulled down with no inclination, and the seal can be secured between the step holes and the discharge nozzles.

Both discharge nozzles are thus opened simultaneously, and the discharge cylinder holds its posture unchanged with no inclination.

The passage block of the cap unit does not move downward unless both manipulating plates are depressed. Even if one of the manipulating plates is depressed involuntarily, the block does not move, and the contents are not discharged disadvantageously.

In addition, since the cap unit is fitted detachably to the discharge nozzles, it can be removed, if necessary, from the nozzles at the times of cleaning after use.

In an embodiment of the invention, the means of carrying out the invention exists in the following configuration: that semicircular connecting guides are standing upright from the edge of the top inner brim of the elliptic cylinder, and guide slits are opened in a part of the passage block, and into which the upward semicircular connecting guides are fitted in a manner that said guides can be slidably moved upward or downward through these guide slits.

In the above-described embodiment of the invention, the passage block or the cap unit can be stably moved upward or downward by allowing the guide slits to be slidably moved up or down along the connecting guides.

In an embodiment of the invention, the containers to be used are aerosol containers.

In an embodiment of the invention, the discharge nozzles of the aerosol containers are opened by the depressing operation of both manipulating plates. The ejected materials come out of the step holes, go through the respective passages, and enter the discharge cylinder. Here the two materials join each other, and are discharged outside together from the mixing and discharge device.

Because the discharge nozzles of both containers are simultaneously pressed down without being inclined by the passage block, sufficient sealing ability can be secured even when the contents are ejected at a high pressure from the aerosol containers. It is also possible to achieve the uniform mixing of the contents when they come out of both containers.

In an embodiment of the invention, the means of carrying out the invention exists in the configuration comprising:

manipulating plates disposed under the hanging plates as the extensions to these plates;

the edge of contact to be used being the lower edge of contact, which is a part of the lower edge of the elliptic cylinder;

a pair of descendible projections disposed at positions on the inner surfaces of the manipulating plates, facing the lower edge of contact, each projection having a guide slope inclined downward so as to come in sliding contact with the lower edge of contact; and said guide slope extending upward from the level of contact with the lower edge of the elliptic cylinder up to a height at least enough to be able to open the discharge nozzles, under the condition that the cap unit remains upheld by the discharge nozzles.

In a configuration of the invention, the lower edge of the elliptic cylinder of the attachment is used as the edge of contact without modification. The manipulating plates are prepared simply by utilizing the hanging plates, which straddle the attachment. This configuration makes it easy to form the manipulating plates of a simple structure.

The assembled mixing and discharge device is held with a hand, and both manipulating plates on the front and rear sides of the device are depressed in a manner to hold the manipulating plates between the thumb and the index finger of the hand holding the device. Then, along the guide slopes inclined downward toward the attachment, the lower edge of contact is lifted together with the containers and the attachment. In a relative movement, the cap unit is pulled down along with the passage block. As a result, the discharge nozzles of both containers are depressed fully and equally.

In an embodiment of the invention, the device further comprises: a pair of support plates provided on the front and rear of the elliptic cylinder, disposed at vertical positions on both sides of, and close to, the hanging plate and the manipulating plate, and projected laterally at a height larger than those of the outer surfaces of the hanging plate and the manipulating plate.

In an embodiment of the invention, the support plates of the attachment support the hanging plates and the manipulating plates of the cap unit from both the right and left sides. These plates prevent the posture of the cap unit from being inclined when some object gets hung up on the hanging plate and the manipulating plate. Even if the containers are sandwiched between other objects from the front and the rear, the support plates bump into these objects and protect the hanging plates and the manipulating plates so as not to be depressed simultaneously.

In an embodiment of the invention, the step latches are formed on both sides of each manipulating plate by expanding the width of the manipulating plate at its lower part and are clicked into place when the latches climb over the lower edges of the support plate.

In an embodiment of the invention, the step latches and their climbing over the lower edges of the support plates prevent reliably the cap unit from coming off unintentionally.

In an embodiment of the invention, a clicking sound is emitted due to the elastic recovery deformation when the step latches have climbed over the edges of the support plates and clicked into place.

In an embodiment of the invention, the assembling of the containers, the attachment, and the cap unit is completed when the step latches have climbed over the lower edges of the support plates and clicked into place. At that time, the completion of assembling can be confirmed from the sound emitted by the step latches that have climbed over the edges and clicked into place. This mechanism has high safety, and the device can be used reliably.

In an embodiment of the invention, the means of carrying out the invention exists in the configuration comprising:

- a window-like opening cut in both hanging plates in the area ranging from the height of almost the central part to the lower end of each hanging plate;
- a manipulating plate disposed in the extended portion of each hanging plate, which extends upward from the lower end via the fold at the bottom;
- a pair of outward brims extending from the lower edge of the elliptic cylinder at its central, front and rear portions;
- the edge of contact to be used being the lower edge of contact which is a part of the lower edge of the outward brim; and
- a descendible projection disposed on the inner surfaces of the manipulating plates, at the position in which the lower edge of contact faces the opening in the hanging plate, each projection having a guide slope inclined downward so as to come in sliding contact with the lower edge of contact, with said guide slope extending upward from the level of contact with the lower edge of the outward brim up to a height at least enough to be able to open the discharge nozzles, under the condition that the cap unit remains upheld by the discharge nozzles after the containers, the attachment, and the cap unit have been assembled.

In a configuration of the invention, the manipulating plate extends upward from the lower end of the hanging plate via the fold at the bottom, with the lower edge of outward brim being used as the edge of contact. This brim enables the guide slope to be contacted with the lower edge of contact at a position spaced from the outer wall of the elliptic cylinder. This means that when the manipulating plates are depressed, it is possible to take a large width of displacement and therefore to have a large distance in which to pull down the discharge nozzles.

In an embodiment of the invention, the means of carrying out the invention exists in the configuration comprising:

- a pair of extended plates having a window-like opening and reaching the fold at the bottom by extending the lower edges of the central, front and rear portions of the elliptic cylinder;
- a pair of manipulating plates extending upward from the lower edges of the extended plates via the fold at the bottom;
- a pair of hanging plates, each having a window-like opening disposed at a height of the roughly central portion;
- the edge of contact to be used being the upper edge of contact, which is a part of the entire bottom side of this opening, said upper edge of contact on the bottom side being located at the position facing the opening of the extended plate, and the lower portion of said hanging plate being sandwiched between the extended plate and the manipulating plate; and
- a descendible projection disposed on the inner surfaces of each manipulating plate, said projection facing the upper edge of contact and having a guide slope inclined upward so as to come in sliding contact with the upper edge of contact on the bottom side, with said guide slope extending downward from the level of contact with the upper edge of contact on the bottom side down to a depth at least enough to be able to open the discharge nozzles, under the condition that the cap unit remains upheld by the discharge nozzles after the containers, the attachment, and the cap unit have been assembled.

In a configuration of the invention, the manipulating plates are connected to the elliptic cylinder, and each hanging plate is provided with a window-like opening and the upper edge of contact. The cap unit is pulled down by the depressing operation of the manipulating plates. Since the containers are not uplifted, the discharge operation is stably carried out.

In an embodiment of the invention, a locking part allows itself to be caught by the edge of contact when the slidable projection on the manipulating plate comes in sliding engagement with the edge of contact.

In an embodiment of the invention, the engagement of the locking part with the edge of contact prevents the cap unit from coming off unintentionally.

In an embodiment of the invention, a clicking sound is emitted due to the elastic recovery deformation caused when the locking part slips into the underside of, or climbs over, the edge of contact and is caught into place.

In an embodiment of the invention, the assembling of the containers, the attachment, and the cap unit is completed when the locking part has slipped into the underside of, or climbs over, the edge of contact and is caught into place. At that time, the completion of assembling can be confirmed from the sound emitted by the locking part that has slipped into the underside of, or climbs over, the edge of contact and clicked into place. This mechanism has high safety, and the device can be used reliably.

In an embodiment of the invention, a brush having many brushing pieces disposed thereon is fitted onto the cap unit, wherein the contents of a pair of containers is mixed and discharged to the top surface of this brush.

In an embodiment of the invention, the contents of the pair of containers can be mixed and directly discharged to the top surface of the brush, and can be applied onto hair of the head and the like in a simple operation.

In an embodiment of the invention, the means of carrying out the invention exists in the configuration comprising:

a passage block to be fitted detachably to the cap unit and comprising a main block body and a bottom plate; said main block body having a discharge cylinder disposed on top of the central portion thereof, through which a mixing rod stands upright, and having a passage wall formed underneath said main block body to open a downward space; and said bottom plate being connected to the rear, lower edge of said main block body by a hinge, and provided with a pair of step holes, into which the discharge nozzles are fitted tightly, projected passage members tightly fitted from underside into the passage wall to form discharge passages, and a tab hanging from the central portion of the bottom plate;

a cap unit comprising a main operating cylinder of an elliptic shape, a top plate connected to the top portion of the main operating cylinder, an elliptic fitting guide that stands upright from the inward brim of the top plate, and a vertical passage cylinder hanging from the center of the top plate and having an exit to the inner area surrounded by the elliptic fitting guide, said cap unit allowing the mixing rod to be inserted into the vertical passage cylinder thereof and also allowing the discharge cylinder to be tightly fined into the vertical passage cylinder therof to assemble the passage block into the main operating cylinder detachably; and a brush to be fitted to the cap unit and comprising a dome attachment covering the top plate, a tight-fitting cylindrical wall, which is disposed inside the dome attachment and is fitted tightly into the elliptic fitting guide, a slit-like discharge port that connects the dome space within the tight-fitting cylindrical wall to the outside of this brush, and many thin brushing pieces disposed standing around the discharge port on the top plate of the dome attachment.

The mixing and discharge device according to an embodiment of the invention comprises an applicator consisting of the brush, the cap unit, and the passage block, namely, the brush and the entire passages for discharging the contents, in addition to the attachment, i.e., the portion to be attached to the containers.

The brush is fitted to the cap unit, by fitting the tight-fitting elliptic wall into the elliptic fitting guide of the cap unit. The passage block can be removed from the cap unit, simply by pinching the tab and pulling it downward. The passage block is removed from the discharge nozzles of the containers at the same time when the applicator is pulled up from the attachment.

The passage block, when removed from the cap unit and the discharge nozzles of the containers, exposes the inside of the discharge cylinder, the inner passage wall, the projected passage members, and both step holes, which are parts of the entire discharge passages, by turning around and opening the bottom plate. Thus, all the discharge passage components are exposed. It becomes possible, therefore, to wash away the content remaining in the passage components readily and fully.

The brush is fitted firmly to the cap unit. Depending on the purpose, it is possible to choose the fitting type between detachable engagement and non-detachable one. The remaining content can be washed away from the combination of the brush and the cap unit after the cap unit has been removed from the attachment, and the passage block, from the cap unit.

In an embodiment of the invention, the means of carrying out the invention exist in the configuration in which the brush is fitted firmly, yet detachably, to the cap unit.

The brush and the cap unit can be fully washed under the condition that these two components are fitted firmly with each other. However, since this configuration enables the brush to be removed from the cap unit, a high washing effect can be achieved as the remaining content can be easily and fully washed away.

In an embodiment of the invention, the brush is fitted non-detachably to the cap unit.

In a configuration of the invention, the combination of the brush and the cap unit does not expose all the discharge passage components, but it is possible to clean the combination of the brush and the cap unit under the conditions that the cap unit has been removed from the attachment and that the passage block has been pulled out. Because the structure is simple, the remaining content can be washed away.

However, because strong fitting of the brush onto the cap unit is secured, it is possible to use the brush under the stable condition and to obtain reliable sealing ability. Now that the brush and the operating unit are not removable from each other, the disassembling of other components and the structure of the device are simplified.

In embodiments of the invention, the containers are aerosol containers.

When the discharge nozzles of aerosol containers are depressed with fingers, considerable depressive force is usually required. Because the depressing stroke is short, it is difficult to control the discharge volumes. In an embodiment of the invention, the depressive force coming from the cap unit is acted on the discharge nozzles via the passage block. It becomes possible for the contents to be ejected by applying relatively small force while controlling the discharge volumes.

In an embodiment of the invention, the mixing rod has a blunt-headed tip.

When the passage block is fitted to the cap unit, the mixing rod is inserted into the vertical passage cylinder of the cap unit. In an embodiment of the invention, the mixing rod having a blunt-headed tip can be inserted smoothly without getting the tip hooked on the cylinder. Thus, the mixing rod can be prevented from being damaged at the time when the device is assembled.

In an embodiment of the invention, the reinforcing ribs are provided to reinforce the lower end of the upright mixing rod and are disposed on the mouth of the discharge cylinder at positions where the ribs do not block the fluid flow path.

When the passage block is fitted to, or removed from, the cap unit, unintentional force may be applied to the mixing rod, when the mixing rod happens to get hooked on another member. At such a time, stress is concentrated on the portion of the lower end of the upright mixing rod. The reinforcing ribs in an embodiment in the invention wind down the concentration of this stress, and prevent the mixing rod from being broken.

DETAILED DESCRIPTION OF PREFERRED EMBODIMENTS

Figure 1:
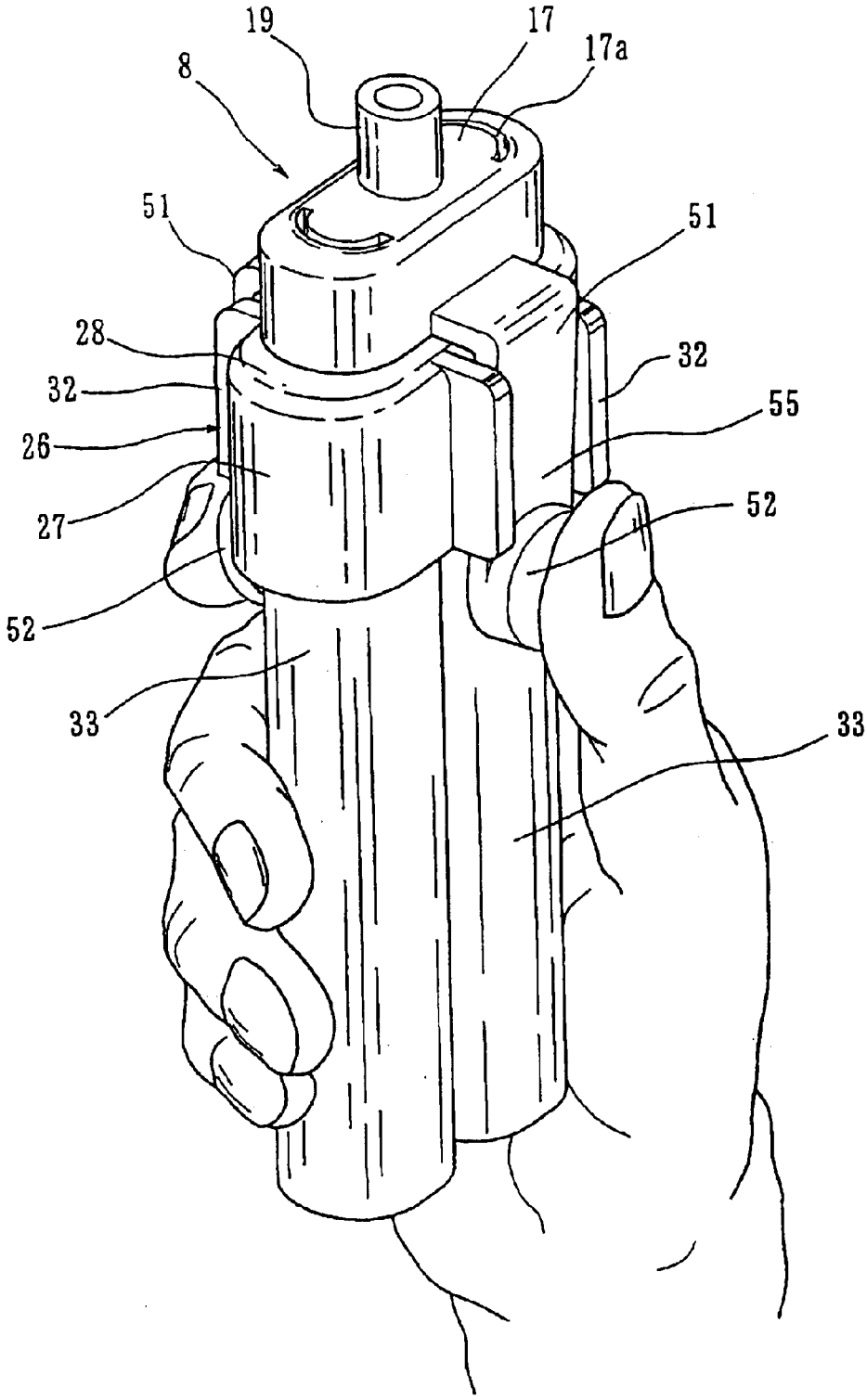
FIG. 1 is an overall perspective view showing the first embodiment of this invention in use.
Figure 2:
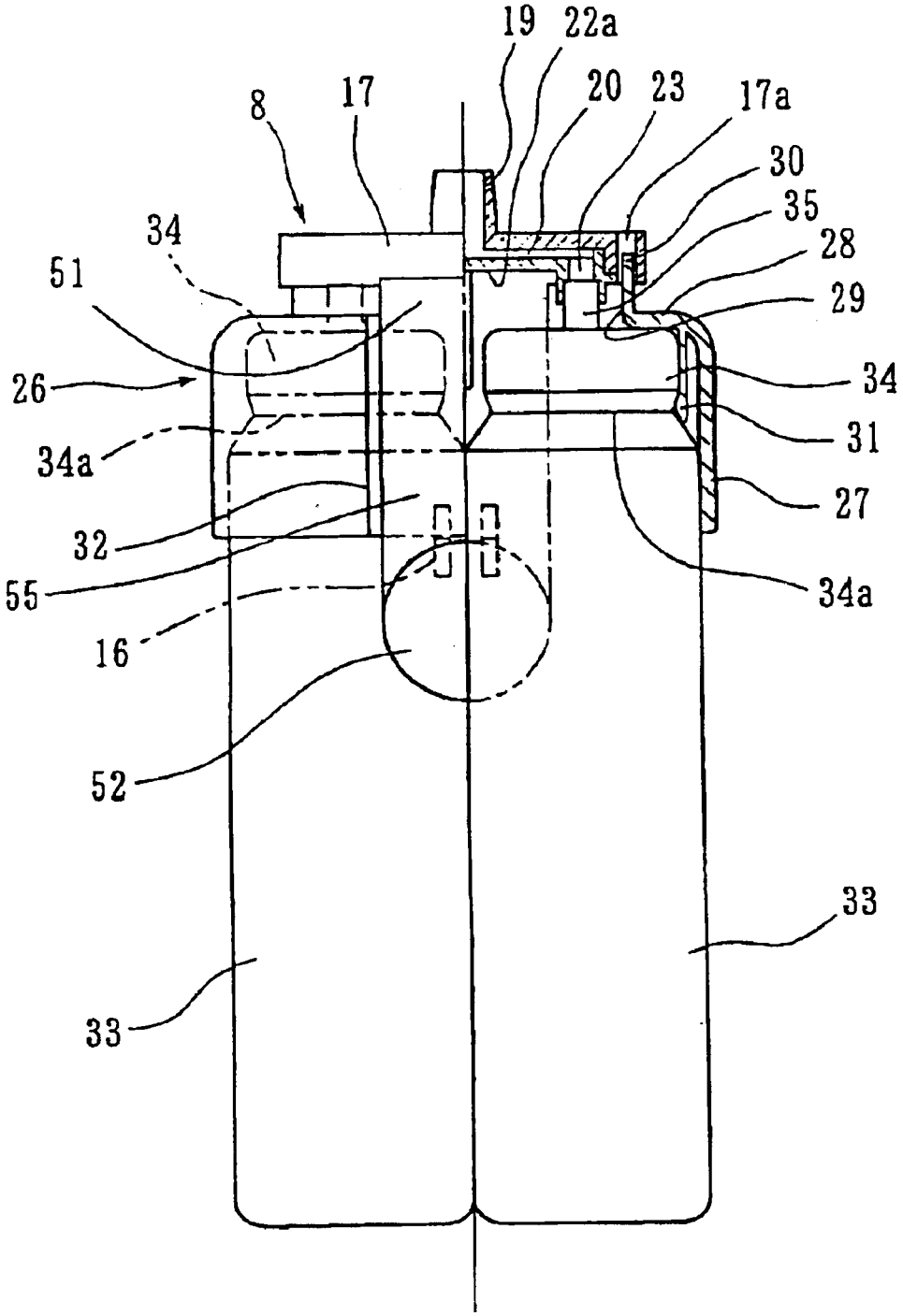
FIG. 2 is a front elevational view showing the attachment and the cap unit in the first embodiment shown in FIG. 1, with the right half being illustrated in longitudinal section.
Figure 3:
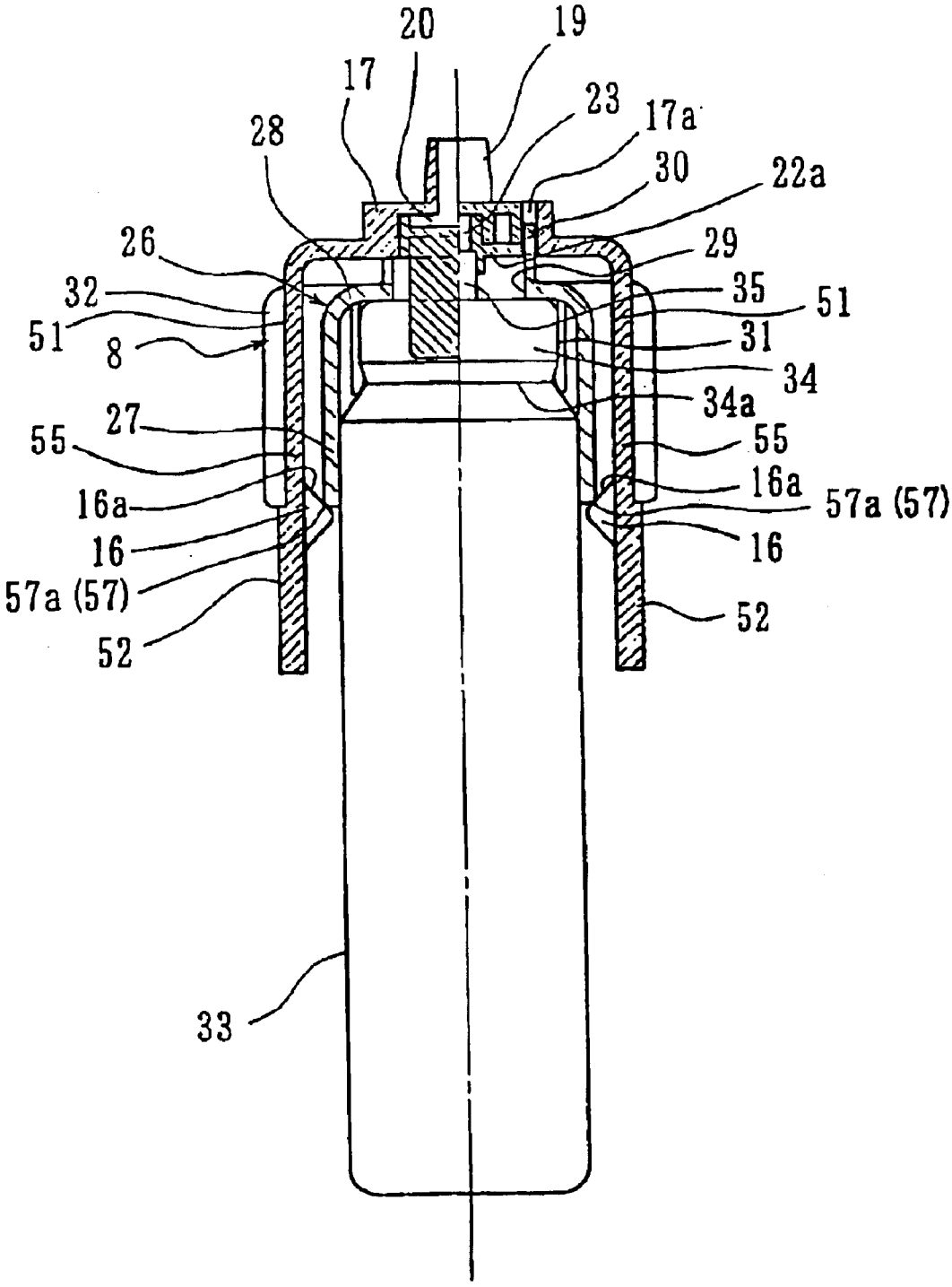
FIG. 3 is a side view showing the attachment and the cap unit in the first embodiment shown in FIG. 1, with the right half being the longitudinal section observed at the center of a container, and the left half being the longitudinal section observed at the center of the mixing discharge device.
Figure 4:
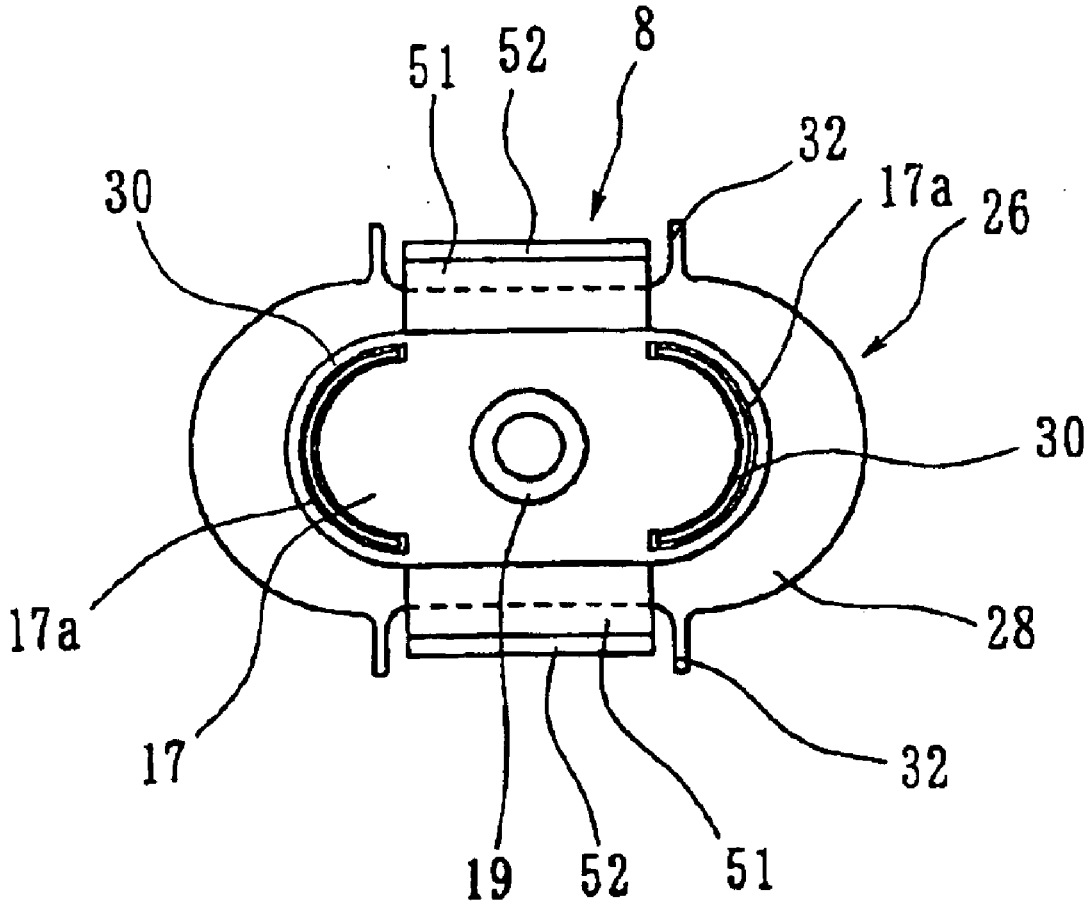
FIG. 4 is an entire plan view showing the mixing and discharge device in the first embodiment.
Figure 5:
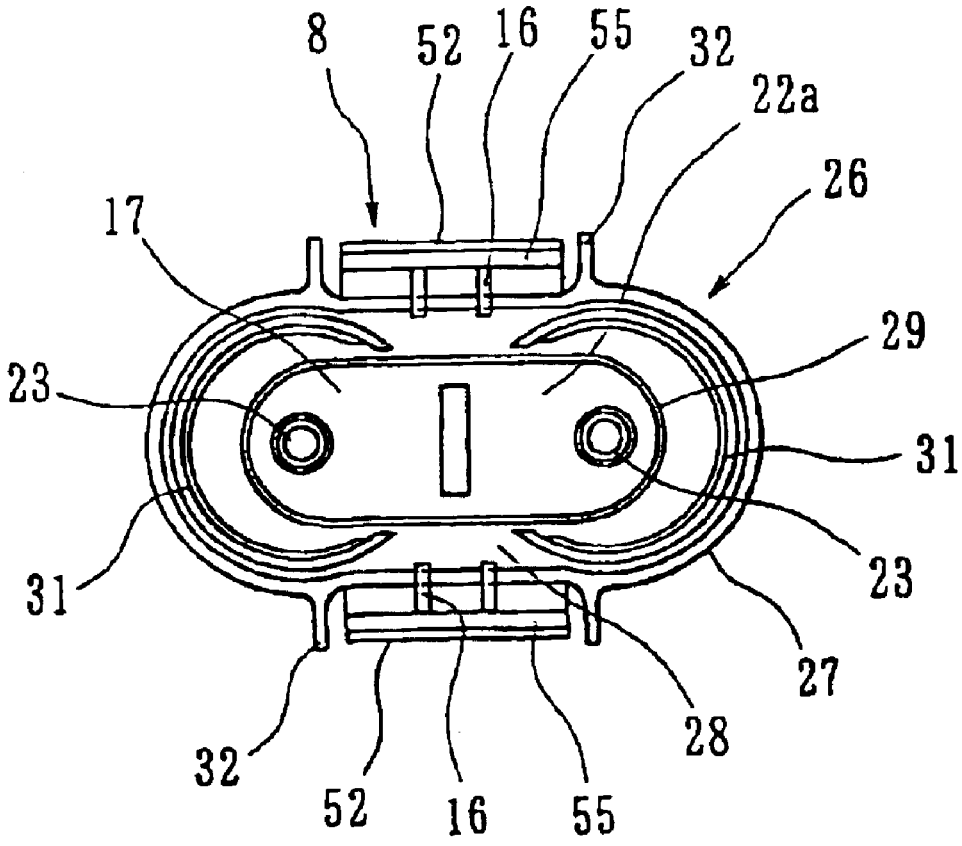
FIG. 5 is a bottom plan view showing a combination of the attachment and the cap unit in the first embodiment.

This invention is further described with respect to the preferred embodiments, now referring to the drawings.

FIGS. 1–5 show the first embodiment of this invention. The containers 33 are aerosol, metallic containers of a long, cylindrical shape, each having a closed end. Each container has the mouth with a diameter narrower than that of the cylindrical body of the container. The metallic or hard resin cap, equipped with a discharge nozzle 35 having a valve-actuated open/close function, is fitted to the mouth by caulking to form the head 34. The discharge nozzle 35 stands upright from this head.

The attachment 26 comprises an elliptic cylinder 27 to be fitted tightly around the top portion of the pair of containers 33 standing next to each other (See FIGS. 1, 2, 3, and 5). The top inward brim 28 is disposed on the top edge of the elliptic cylinder 27, and this brim forms an opening 29 to the attachment 26. The downward fitting guides 31 are suspended in an arc shape from under the top inward brim 28 at the positions on the right and left sides facing each other. These guides 31 are fitted to the outer semicircles of the heads 34 of the containers 33 by the undercut engagement with the circular groove 34*a* disposed right under each head 34. The semicircular connecting guides 30 in a pair are disposed upright from the edge of, and on both the right and left sides of, the top inward brim 28, facing each other across the opening 29. In addition, a pair of support plates 32 is disposed vertically, apart from each other, at the centers of the front and rear surfaces of the elliptic cylinder 27.

The attachment 26 is fitted, from above, around the pair of containers 33 that take the side-by-side position. Both downward fitting guides 31 are engaged strongly and firmly with the heads 34 of the containers 33, and the discharge nozzles 35 come out of the opening 29.

The main body of the attachment 26 comprises an elliptic cylinder 27. Under the condition that the attachment 26 is fitted around the pair of containers 33, a space is created at the center between the front and rear walls of the attachment, forming a valley between two adjacent containers 33.

The cap unit 8 (See FIGS. 1, 2, 3, and 4) comprises a passage block 17 and a pair of hanging plates 51. The passage block 17 is provided with the round step holes 23, into which the discharge nozzles 35 are fitted tightly from underside and are bumped against the overhang of these step holes 23. A discharge cylinder 19 is disposed at the center of the top portion and stands upright on top of this cap unit 8 to form a discharge port. The passage block 17 is also provided with discharge passages 21 for connecting the discharge port with the round step holes 23. The guide slits 17*a* are opened in a part of the passage block 17 and into which the semicircular connecting guides 30 are fitted in a manner that the guides 30 can be easily slid upward or downward. A pair of hanging plates 51 comes out of the central, front and rear portions of the passage block 17, hangs down on the front and rear walls of the elliptic cylinder 27, and the manipulating plates 55 are provided by extending these hanging plates 51.

The descendible projections 16 in a pair are triangular plate-like projections having a downward guide slope 16*a* on the upper side. The pair of right and left projections 16 is disposed on the back of each manipulating plate 55 at the positions opposite to the lower dges of contact 57*a*, which are the lower edges on the front and rear surfaces of the elliptic cylinder 27. Under the condition that the discharge nozzles 35 have been fitted into the step holes 23, the lower part of the guide slope 16*a* lightly comes in sliding contact with the lower edge of contact 57*a* of the elliptic cylinder 27. The manipulating plate 55 is thus provided with the descendible projections 16 on the rear surface and with a thick push button 52 on the outer surface thereof.

When the cap unit 8 has been fitted to the combination of the container pair 33 and the attachment 26, both the hanging plate 51 and the manipulating plate 55 are located between a pair of support plates 32 and hang down on each of the front and rear surfaces of the elliptic cylinder 27. The outermost portions of the hanging plate 51 and the manipulating plate 55 do not protrude outward beyond the height of the support plates 32 projected laterally and placed on both sides of these plates 51 and 55.

Under the condition that the cap unit 8 has been fitted to the combination of the container pair 33 and the attachment 26, the lower parts of the guide slopes 16*a* of descendible projections 16 come lightly in contact with this lower edge of contact 57*a*. Since the guide slope 16*a* is locked lightly by the lower edge of the elliptic cylinder 27, this locking force works to keep the cap unit 8 in its fitted position.

The elliptic cylinder 27 and the container pair 33 create space in the central portions between the two containers at the front and the rear of the device. Since the descendible projections 16 of each manipulating plate 55 are located in this central portions, these projections 16 displace inward with no bumping against either container 33, and pull down both manipulating plates 55 without fail when the manipulating plates 55 were depressed by pinching the front and rear push buttons with a thumb and a finger.

In the case of this embodiment, the passage block 17 comprises the main block body of a top cover shape and a bottom plate 22*a* for the convenience of forming discharge passages 21. The bottom plate 22*a* fits in tightly with the underside of the main block body, and has a pair of step holes 23 opened at two opposite ends.

The illustrated discharge cylinder 19 has a short, cylindrical shape, but its structure is not limited to a short cylinder. For example, the cylinder may be a narrow, elliptic cylinder, or may be fitted with a brush in which the discharge port is disposed among the teeth of the brush.

Figure 6:
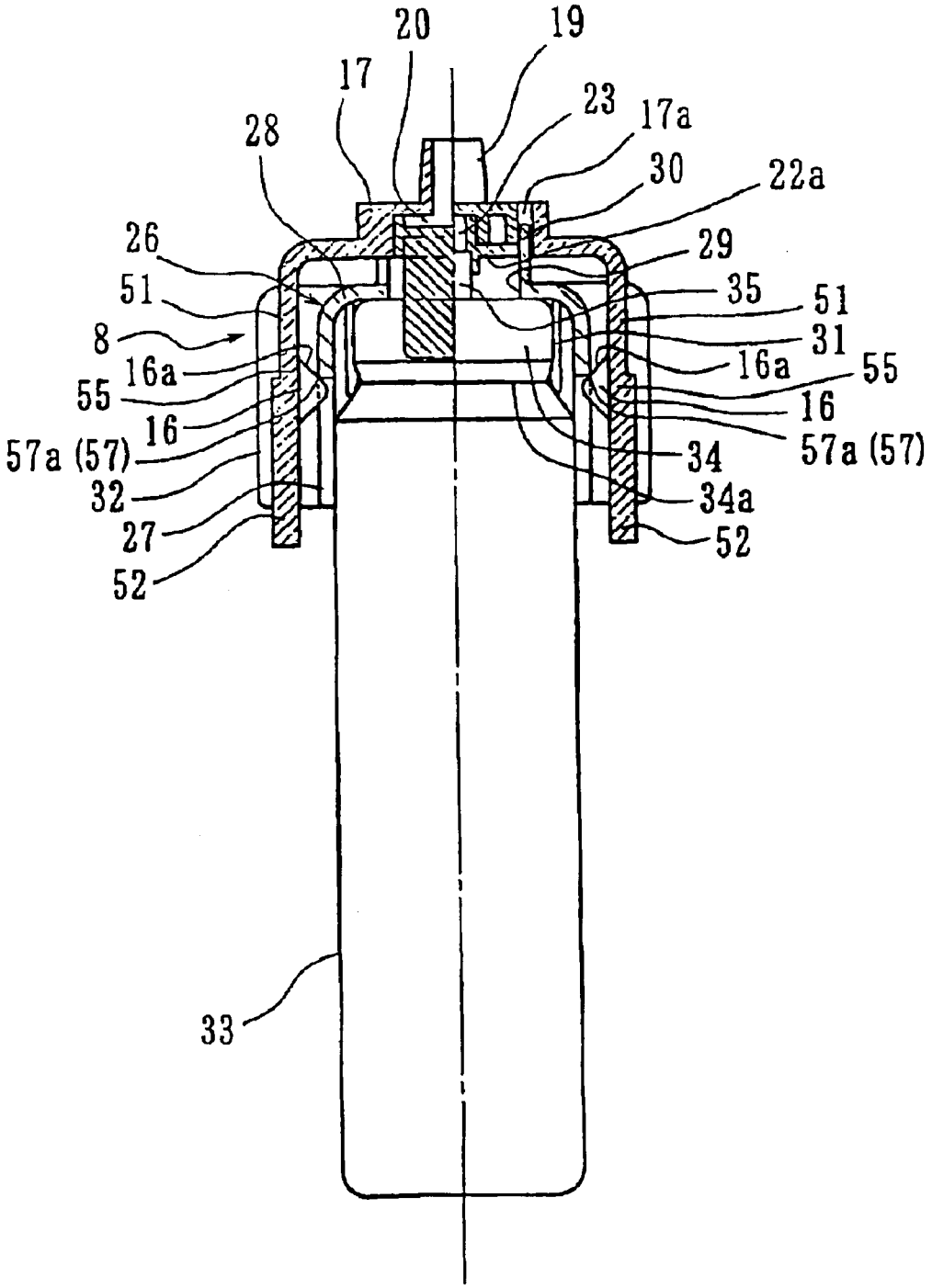
FIG. 6 is a side view showing the attachment and the cap unit in the second embodiment of this invention, with the right half being the longitudinal section observed at the center of a container, and the left half being the longitudinal section observed at the center of the mixing and discharge device.

FIG. 6 shows the second embodiment of this invention. Cutouts are formed by cutting out a rectangular portion from the elliptic cylinder 27 of the first embodiment in the central part of the front and rear walls. The outer edge of the topside in the cutout is used as the lower edge of contact 57*a* on the elliptic cylinder 27. This enables the length of each hanging plate 51 to be shortened while maintaining the height of elliptic cylinder 27 necessary to hold the container pair 33 stably in the side-by-side arrangement.

Figure 7:
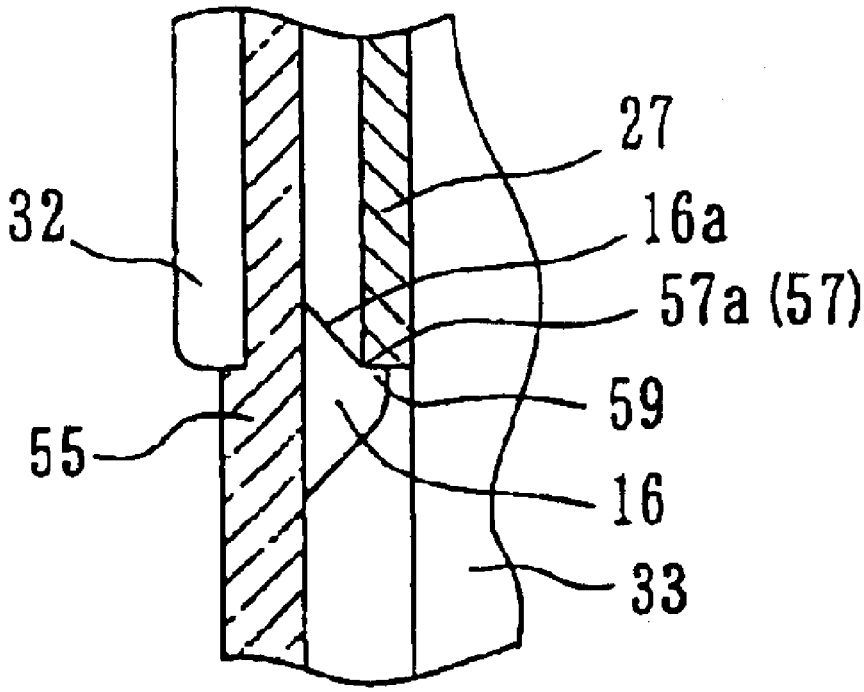
FIG. 7 is an enlarged view of a critical portion of the mixing and discharge device in the third embodiment of this invention, showing the locking engagement in longitudinal section.

FIG. 7 shows the third embodiment of this invention, in which at the pointed tip of the descendible projection 16 of the first embodiment, there is provided a locking part 59 that allows itself to be caught by the lower edge of contact 57*a* on the elliptic cylinder 27. This engagement of the locking part with the lower edge of contact prevents the cap unit from coming off unintentionally.

In the configuration of FIG. 7, a clicking sound is emitted due to the elastic recovery deformation caused when the guide slope of the descendible projection 16 bumps against the lower edge of contact 57*a* and is caught into place. At that time, the completion of assembling can be confirmed from this sound. This mechanism has high handling ability and safety, and thus the device can be used reliably.

Figure 8A:
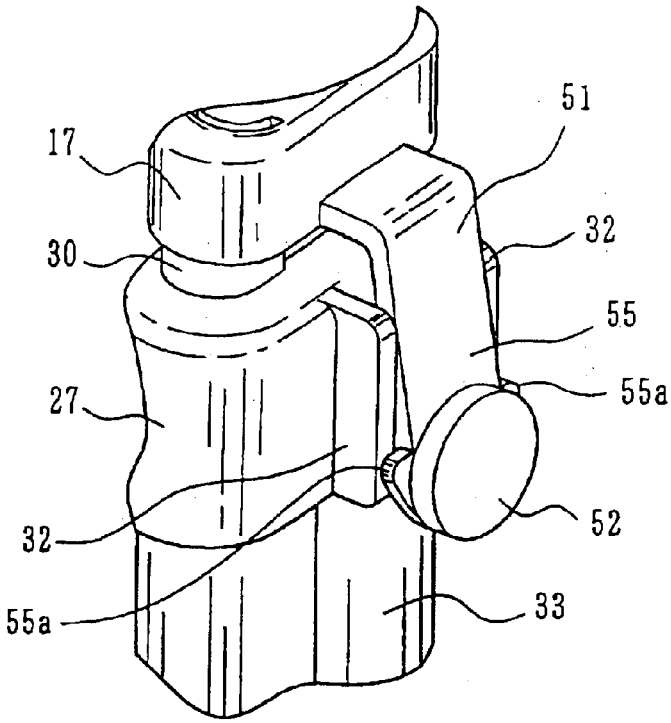
FIGS. 8*a* and 8*b* are schematic diagrams in a partial, perspective view showing the mechanism of the step latches in the fourth embodiment of this invention.
Figure 8B:
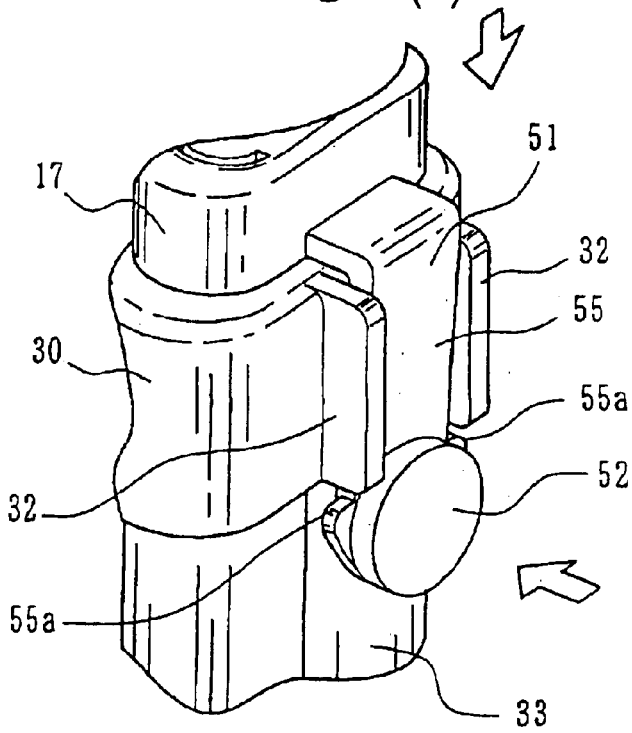

FIG. 8 shows the fourth embodiment of this invention, in which the step latches 55*a* are formed on both sides of each manipulating plate 55 of the first embodiment, by expanding the width of the manipulating plate 55 at its lower part and are clicked into place when the latch climbs over the lower edge of each support plate 32. In this configuration, the step latches 55*a* and their climbing over the lower edges of the support plates 32 prevent the cap unit reliably from coming off unintentionally.

Except for the above-described step latches 55*a*,this embodiment is similar to the first embodiment (See FIG. 3) in the configuration comprising the descendible projections 16, the guide slopes 16*a*, and the lower edges of contact 57*a*. Due to the elastic recovery deformation that takes place when the step latches 55*a* climb over the lower edges of the support plates 32, a clicking sound is emitted from the bump of the guide slope 16*a* of the descendible projection 16 against the lower edge of contact 57*a*. The completion of assembling can be confirmed from this sound. This mechanism has high handling ability and safety, and the device can be used reliably.

Figure 9:
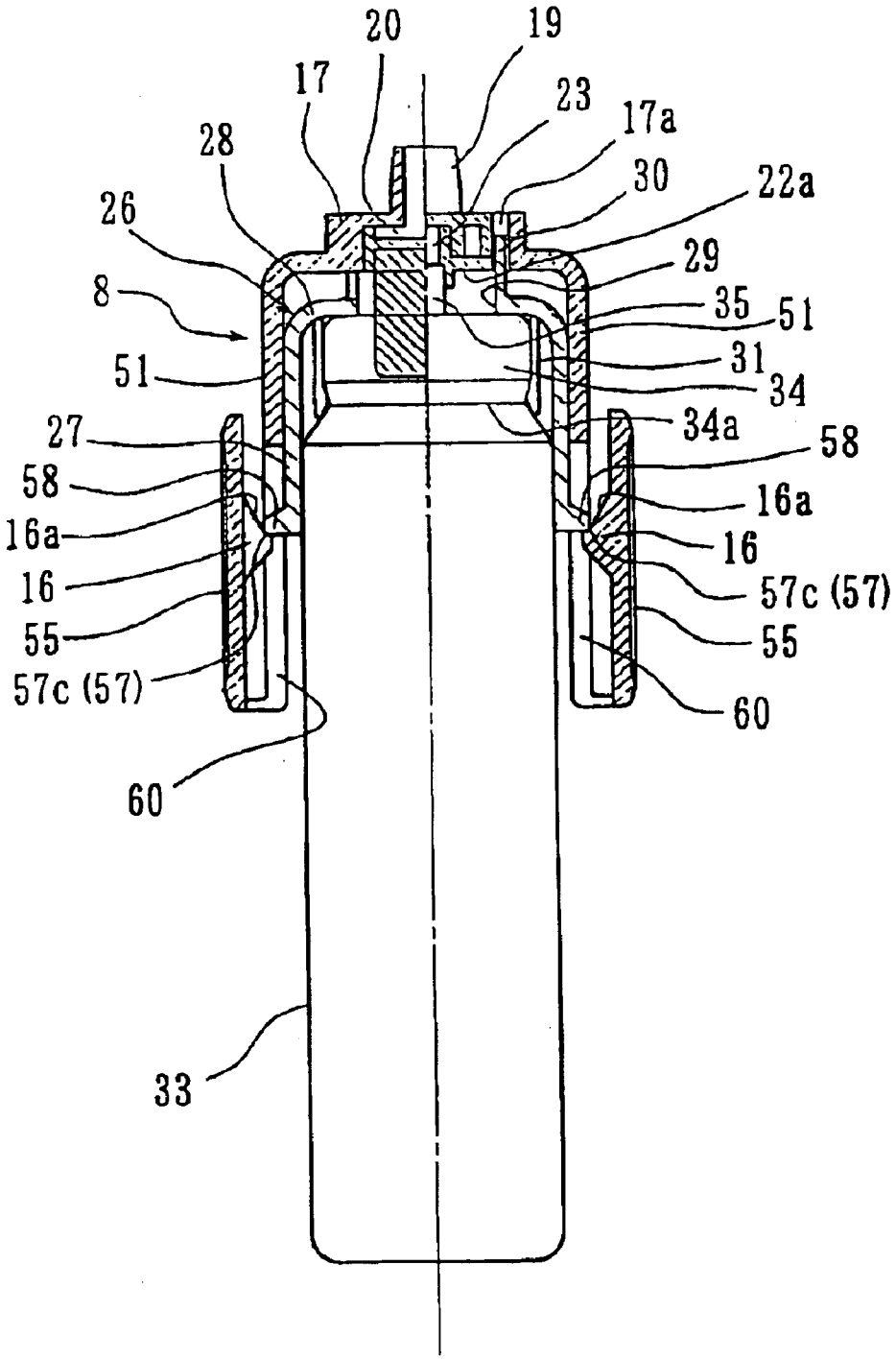
FIG. 9 is a side view showing the attachment and the cap unit in the fifth embodiment, with the right half being the longitudinal section observed at the center of a container, and the left half being the longitudinal section observed at the center of the mixing and discharge device.

FIG. 9 shows the fifth embodiment of this invention, in which the configuration of the hanging plate 51 and the manipulating plate 55 in the first embodiment has been changed positionally.

In this embodiment, a pair of outward brims 58 extends from the lower edge of the elliptic cylinder 27 at its central, front and rear portions, and the edge of contact 57 to be used is the lower edge of contact 57c which is a part of the lower edge of the outward brim 58. The window-like opening 60 is cut in both hanging plates 51 in the area ranging from the height of almost the central part to the lower end of each hanging plate 51. The manipulating plate 55 is disposed in the extended portion of each hanging plate 51, which extends upward from the lower end via the fold at the bottom. A descendible projection 16 is disposed on the inner surface of each manipulating plate 55, and the projection has a guide slope 16*a* inclined downward so as to come in sliding contact with the lower edge of contact 57*c*.

The outward brim 58 is disposed at the position facing the opening 60 of the hanging plate 51, and the lower portion of the guide slope 16*a* is lightly in contact with the lower edge of contact 57*c*, under the condition that the containers 33, the attachment 26, and the cap unit 8 have been assembled.

In the configuration of this embodiment, the manipulating plate 55 extends upward from the lower end of the hanging plate 51 via the fold at the bottom, and the lower edge of outward brim 58 is used as the edge of contact 57. This brim enables the guide slope 16*a* to get in contact with the edge of contact 57 at a position spaced from the outer wall of the elliptic cylinder 27. This means that when the manipulating plates 55 are depressed, it is possible to take a large width of displacement and therefore to have a large distance in which to pull down the discharge nozzles 35. Thus, it also becomes easy to use the mixing and discharge device of a pumping type, which requires a relatively large depressive length.

Figure 10:
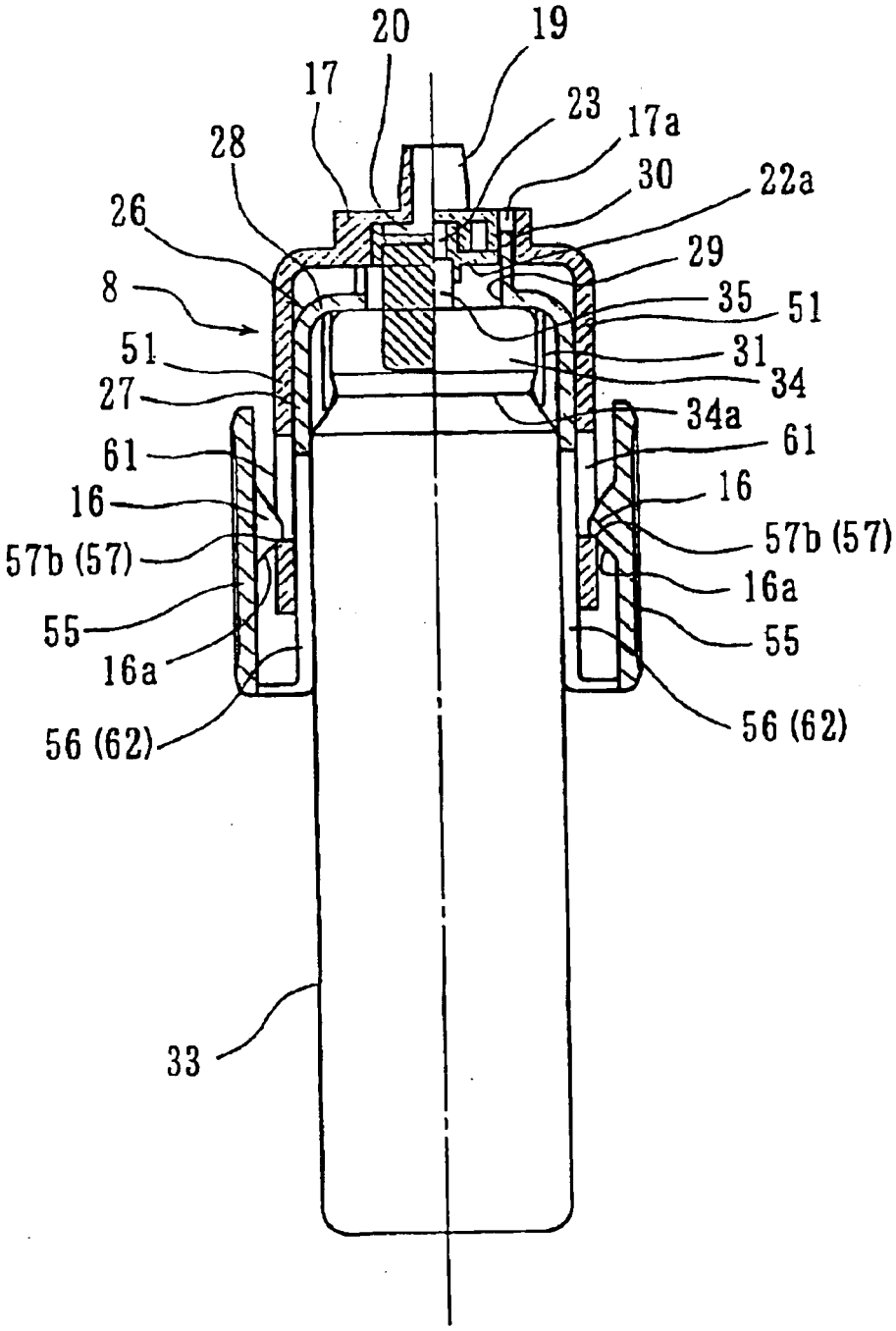
FIG. 10 is a side view showing the attachment and the cap unit in the sixth embodiment, with the right half being the longitudinal section observed at the center of a container, and the left half being the longitudinal section observed at the center of the mixing and discharge device.
Figure 11:
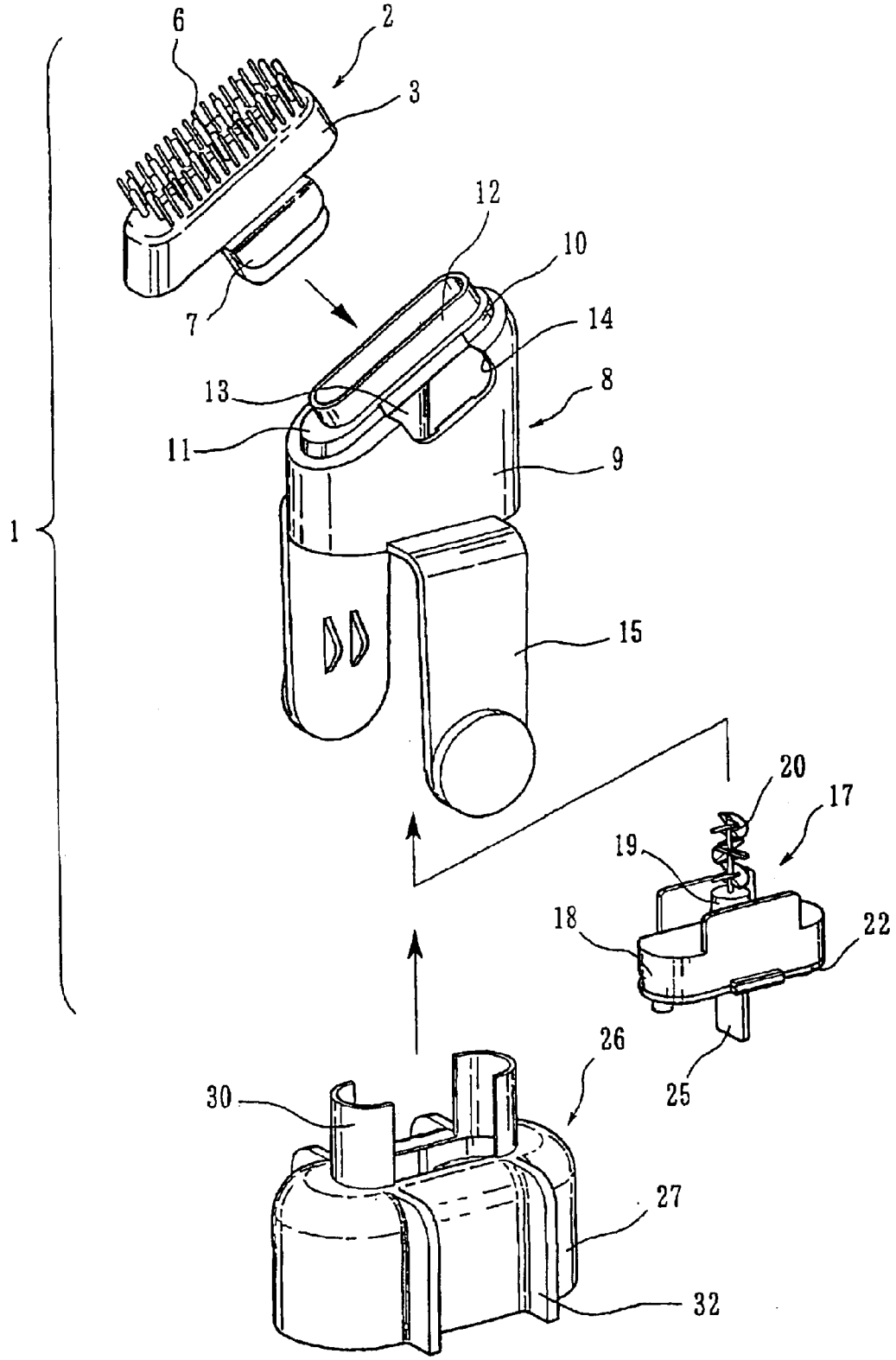
FIG. 11 is an exploded diagram showing the mixing and discharge device in the seventh embodiment of this invention.

FIG. 10 shows the sixth embodiment of this invention, in which, in contrast to the first embodiment, the manipulating plate 55 is disposed on the elliptic cylinder 27, while the edge of contact 57 is disposed on the hanging plate 51.

In this configuration, a window-like opening 61 is disposed at a height of the roughly central portion of each hanging plate 51. Used as the edge of contact 57, the upper edge of contact 57*b* is a part of the entire bottom side of this opening 61. A pair of extended plates 56 has a window-like opening 62 and reaches the fold at the bottom by extending downward the lower edges of the central, front and rear portions of the elliptic cylinder 27. A pair of manipulating plates 55 extends upward from the lower edges of the extended plates 56 via the fold at the bottom. A descendible projection 16 is disposed on the inner surface of each manipulating plates 55, and the projection has a guide slope 16*a* inclined upward so as to come in sliding contact with the upper edge of contact 57*b* on the bottom side. A locking part 59 is disposed at the tip of the guide slope 16*a*.

The lower portion of the hanging plate 51 is sandwiched between the extended plate 56 and the manipulating plate 55, and the upper edge of contact 57*b* in the window-like opening 61 is located at the position facing the opening 62 of the extended plate 56 and lightly coming in contact with the upper part of the guide slope 16*a*, under the condition that the containers 33, the attachment 26, and the cap unit 8 have been assembled.

In this embodiment, the manipulating plate 55 is connected to the elliptic cylinder 27. The cap unit 8 is pulled down by the depressing operation of the manipulating plates 55. Since the containers 33 are not uplifted, the discharge operation is stably carried out.

FIGS. 11–19 show the 7th embodiment of this invention. The containers 33 are aerosol containers and are metallic containers of a long, cylindrical shape, each having a closed end. Each container has the mouth with a diameter narrower than that of the cylindrical body of the container. The metallic cap, equipped with a discharge nozzle 35 having a valve-actuated open/close function, is fitted to the mouth by caulking to form the head 34. The discharge nozzle 35 stands upright from this head.

The attachment 26 (See FIG. 19) comprises an elliptic cylinder 27 to be fitted tightly around the top portion of the pair of containers 33 standing next to each other. The top inward brim 28 is disposed on the top edge of the outer attachment wall and this brim forms an opening 29 of the attachment 26. The downward fitting guides 31 are suspended in an arc shape from under the top inward brim 28 at the positions on the right and left sides facing each other. These guides 31 are fitted to the outer semicircles of the heads 34 of the containers 33 by the undercut engagement with the circular groove disposed right under each head 34. The semicircular connecting guides 30 in a pair are disposed upright from the edge of, and on both the right and left sides of, the top inward brim 28, facing each other across the opening 29. In addition, a pair of support plates 32 is disposed vertically, apart from each other, at the centers of the front and rear surfaces of the elliptic cylinder 27.

The attachment 26 is fined, from above, around the pair of containers 33 that take the side-by-side position. Both of the downward fitting guides 31 are engaged strongly and firmly with the heads 34 of the containers 33, and the discharge nozzles 35 come out of the opening 29.

The main body of the attachment 26 comprises an elliptic cylinder 27. Under the condition that the attachment 26 is fitted around the pair of containers 33, a space is created at the center between the front and rear walls of the attachment 26, forming a valley between two adjacent containers 33.

Among the brush 2, the cap unit 8, and the passage block 17, which constitute the applicator 1, the passage block 17 (See FIG. 18) comprises a main block body 18, which is provided with the discharge cylinder 19 at the central, upper part. A mixing rod 20 stands upright, extending from the inside of the discharge cylinder 19, and is provided with plural slanted blades 20*a*. Underneath, a passage wall 21 of an elliptic shape opens a downward space. A hinge connects this main block body 18 with bottom plate 22. The bottom plate 22 is provided with a pair of step holes 23, into which the discharge nozzles 35 of the containers 33 are fitted tightly in a manner that prevents the nozzles from breaking through the holes. Projected passage members 24 are disposed on the upper side of the bottom plate 22 and are tightly fitted into passage wall 21 from underside to form the discharge passages and to connect the pair of step holes 23 to the passages. The bottom plate 22 is provided with a tab 24 at the center on the underside. The bottom plate 22 enters a locking engagement with the lower periphery of the passage wall 24 as the edge of the bottom plate 22 climbs over the latch and clicks into place to secure the closed state for the bottom plate 22.

Among the brush 2, the cap unit 8, and the passage block 17, which constitute the applicator 1, the cap unit 8 (See FIGS. 16 and 17) comprises a main operating cylinder 9 of an elliptic shape. A fitting step 10 is disposed on the main operating cylinder 9 at an inclined angle of 20–40 degrees, preferably an angle of 30 degrees downward from the right to the left. On the fitting step 10 is a top plate 11. An elliptic fitting guide 12 is mounted on the top plate 11. A vertical passage cylinder 13 is suspended from an opening inside this elliptic fitting guide 12. A pair of locking apertures 14 is opened in the areas on both sides of the main operating cylinder 9, ranging from the central portion to where the fitting step 10 is. A manipulating plate 55 is disposed at the center on each side of the main operating cylinder 9, hanging down from the lower edge, and is provided with a pair of descendible projections 16 on the inner surface of each plate to pull down the cap unit 8.

This cap unit 8 is provided with the descendible projections 16, which are disposed on the inner surface of the lower portion of each manipulating plate 55 at the position facing the lower edge of contact that is a part of the lower edge of the elliptic cylinder 27, at the time when the cap unit 8 is fitted to the attachment 26, thus allowing the manipulating plate 55 to take a straddling posture, under the conditions that the passage block 17 has been fitted to the cap unit 8 and that the discharge nozzles 35 have been fitted tightly into the step holes 23 of the passage block 17. The upper sides of these descendible projections 16 are downhill inward, and are lightly in contact with the lower edge of contact on the elliptic cylinder 27.

Therefore, if both of the manipulating plates 55 are depressed by pinching the lower portions with the thumb and a finger, the cap unit 8 is pulled down together with the passage block 17, and as a result, the discharge nozzles 35 are also depressed, due to the action of the slopes of the descendible projections 16, which are lightly in contact with the lower edge of contact on the elliptic cylinder 27.

In the 7th embodiment of this invention, containers 33 of the aerosol type are used. However, it is also possible to use the containers 33 of the pumping type because the discharge nozzles 35 are depressed by the depressing operation of the manipulating plates 55 and because this depressing operation can also be used for the pumping type.

After the cap unit 8 has been fitted to the combination of a pair of containers 33 and the attachment 26, both of the manipulating plates 55 are located respectively between a pair of support plates 32, and hang on the front and rear surfaces of the elliptic cylinder 27. The outer surfaces of the manipulating plates 55 are never protruded outward beyond the lateral height of the support plates 32 disposed on both sides of each manipulating plate 55.

Under the condition that the cap unit 8 has been fitted to the combination of the container pair 33 and the attachment 26, both of the descendible projections 16 of the manipulating plates 55 come lightly in contact with the lower edge of contact on the elliptic cylinder 27. Since the descendible projections 16 are locked lightly by the lower edge of the elliptic cylinder 27, this locking force works to keep the cap unit 8 in its fitted position.

The elliptic cylinder 27 and the container pair 33 create a space in the central portions between the two containers at the front and the rear of the device. Since the descendible projections 16 of each manipulating plate 55 are located in this central portions, these projections 16 displace inward with no bumping against either container 33, and pull down both manipulating plates 55 without fail when the plates were depressed by pinching the front and rear plates with the thumb and a finger.

The manipulating plates 55 in this embodiment are suspended from the cap unit 8, are contacted with the lower edge of contact on the elliptic cylinder 27, and are depressed by pinching both manipulating plates 55 with the thumb and a finger. However, this invention is not limited to this configuration. A pair of manipulating plates 55 can be disposed on either one of the cap unit 8 or the elliptic cylinder 27 at positions facing the central portions on the front and rear sides of the elliptic cylinder 27, and a portion corresponding to the lower edge of contact on the other one of the cap unit 8 or the elliptic cylinder 27.

The passage block 17 is fitted to the cap unit 8 by fitting the passage block 17 into the main operating cylinder 9 under the conditions that the mixing rod 20 has been inserted into the vertical passage cylinder 13 and that the discharge cylinder 19 has been tightly fitted into the vertical passage cylinder 13. Under these conditions, the two types of contents are kneaded by the multiple blades 20*a* and are fully mixed as the contents pass through the vertical passage cylinder 13.

Under the condition that the passage block 17 has been fitted to the cap unit 8, a clearance is left between the passage block 17 and the right and left walls of the main operating cylinder 9, where the semicircular fitting guides 30 on the attachment 26 allow the cap unit 8 to slide upward and downward. Because of this clearance and play for the fitting guides 30, the cap unit 8 can maintain stable fitting posture against the attachment 26.

Among the brush 2, the cap unit 8, and the passage block 17, which constitute the applicator 1, the brush 2 (See FIGS. 14 and 15) in the 7th embodiment is fitted detachably to the cap unit 8, and comprises a dome attachment 3 to be fitted around the fitting step 10 of the cap unit 8, a tight-fitting cylindrical wall 4, which is suspended inside the dome attachment 3 and is fitted tightly into the elliptic fitting guide 12, a slit-like elongated discharge port 5 that extends from side to side in the ceiling portion of the dome attachment 3 and connects the dome space within the tight-fitting cylindrical wall 4 to the outside of this brush 2, a large number of thin brushing pieces 6 disposed standing around the discharge port 5 on the top surface of the dome attachment 3, and a pair of attaching legs 7, which is suspended at the central portions on both the front and rear walls of the dome attachment 3 to enter the locking apertures 14 of the cap unit 8 for the locking engagement.

Figure 13:
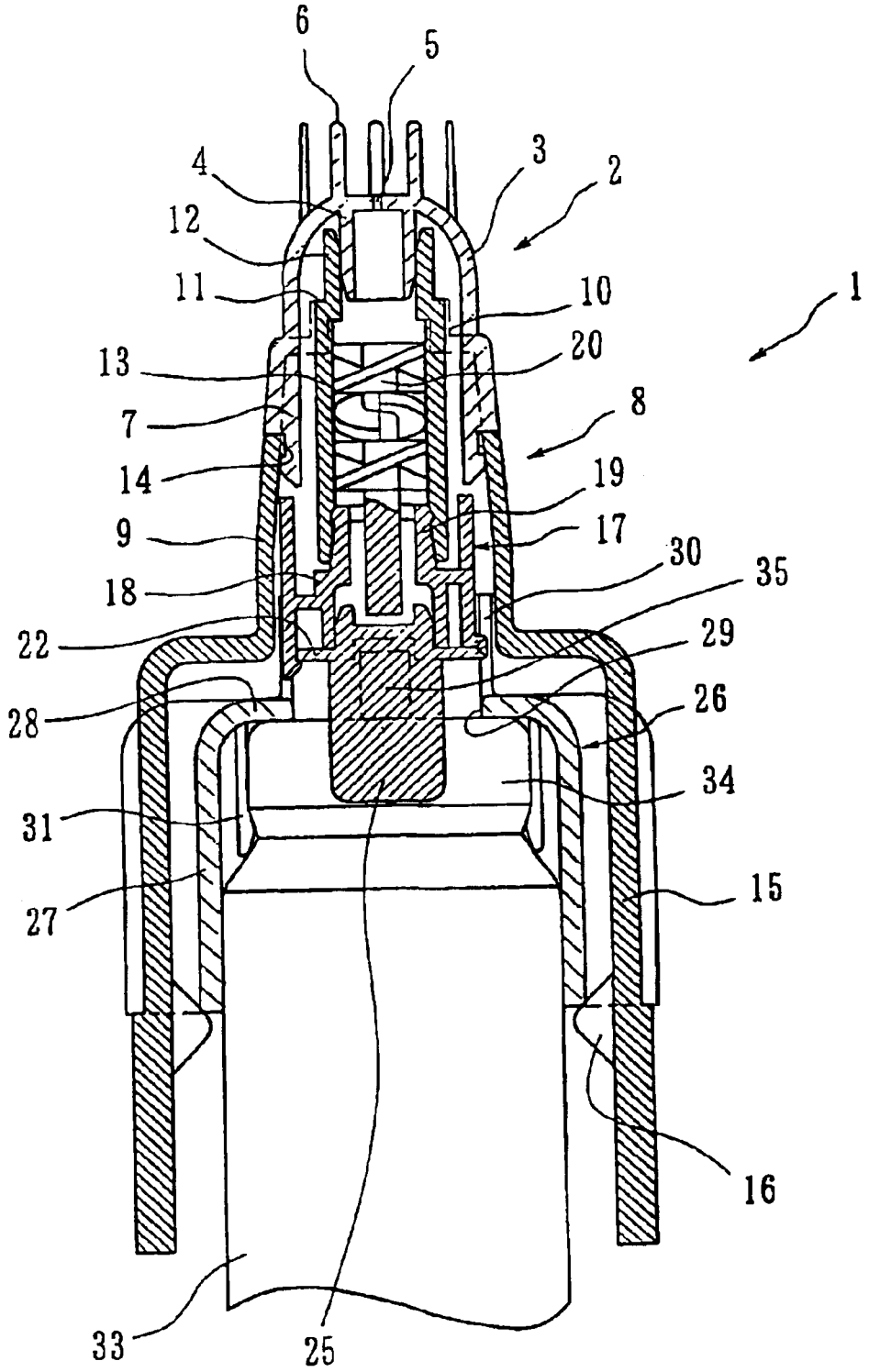
FIG. 13 is an irregularly drawn, side longitudinal section of the mixing and discharge device shown in FIG. 11.
Figure 14:
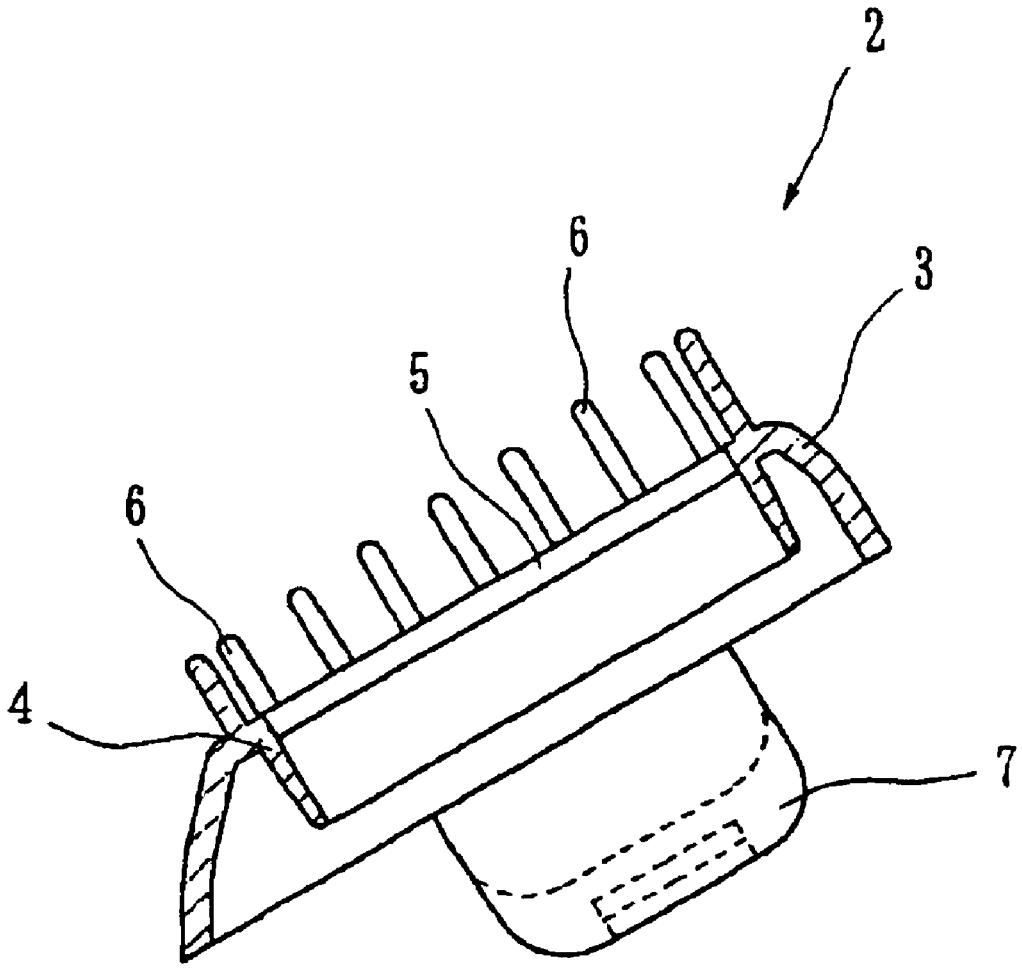
FIG. 14 is a front longitudinal section of the brush shown in FIG. 11.
Figure 15:
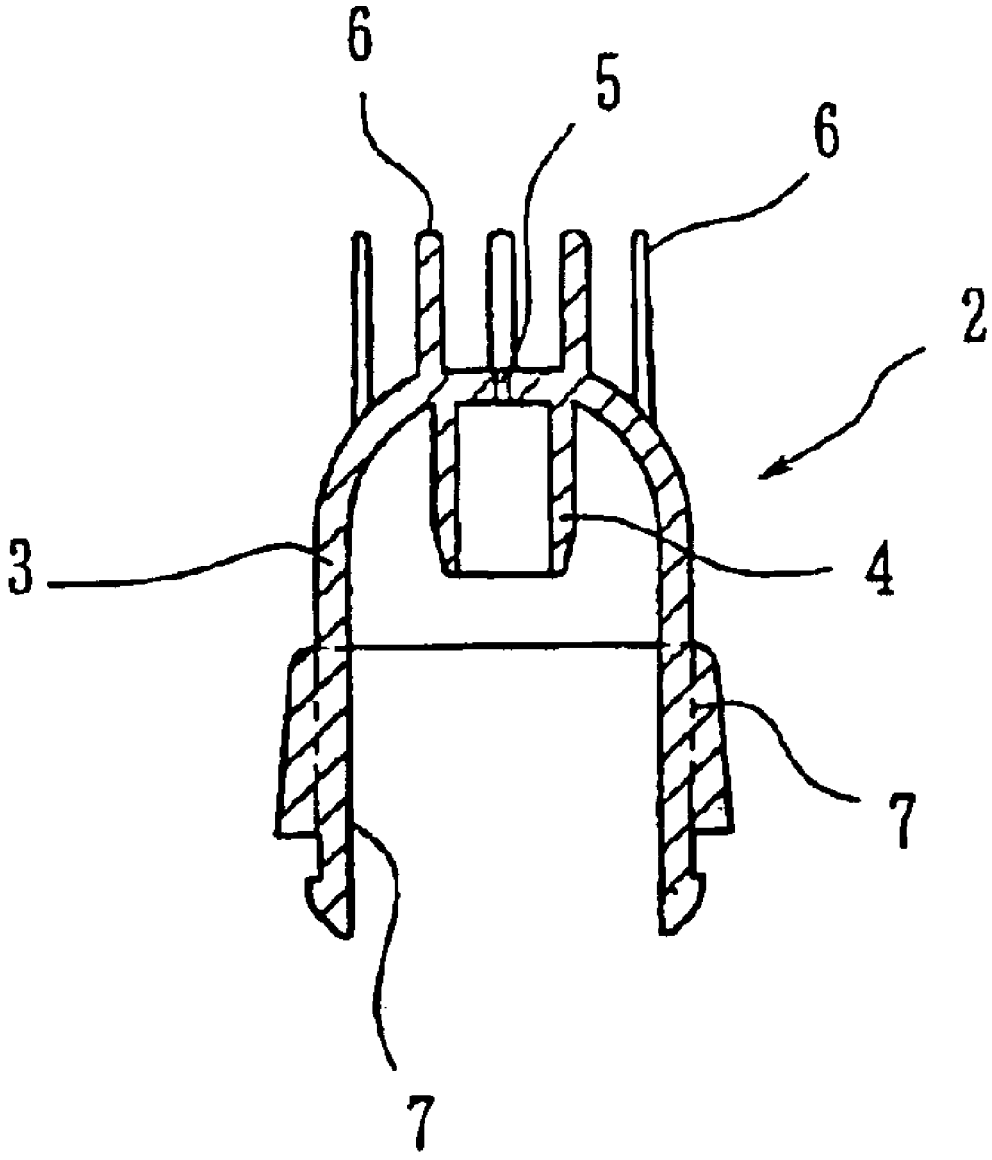
FIG. 15 is a side longitudinal section of the brush shown in FIG. 14.
Figure 16:
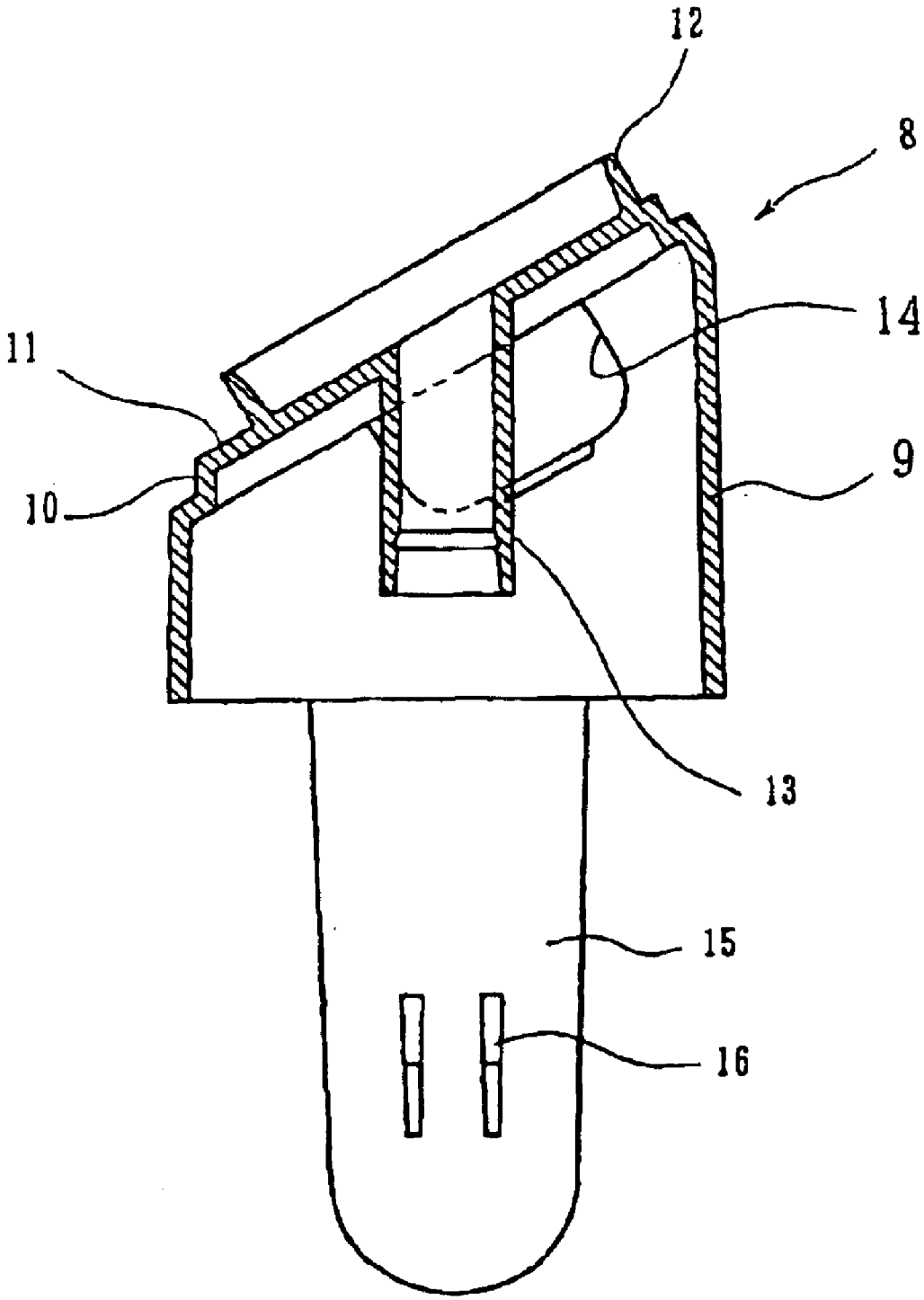
FIG. 16 is a front longitudinal section of the cap unit in the seventh embodiment shown in FIG. 11.
Figure 17:
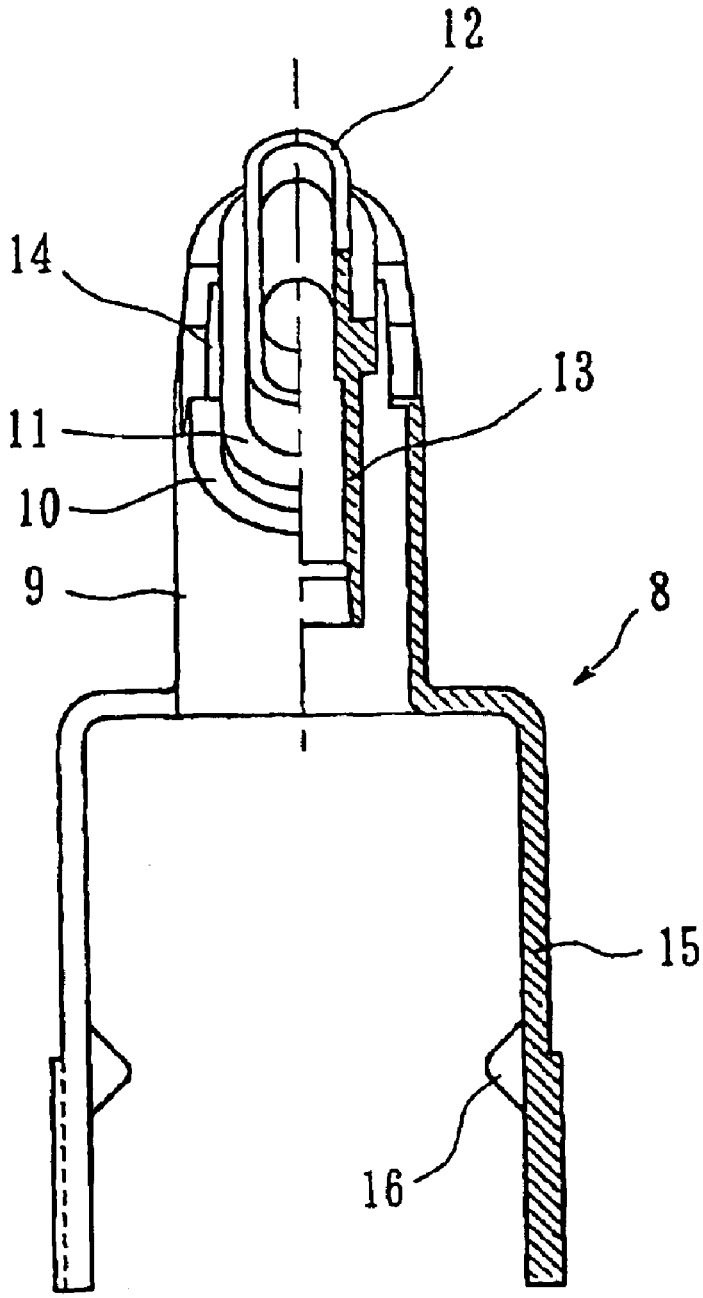
FIG. 17 is a side semi-longitudinal section of the cap unit shown in FIG. 16.
Figure 18:
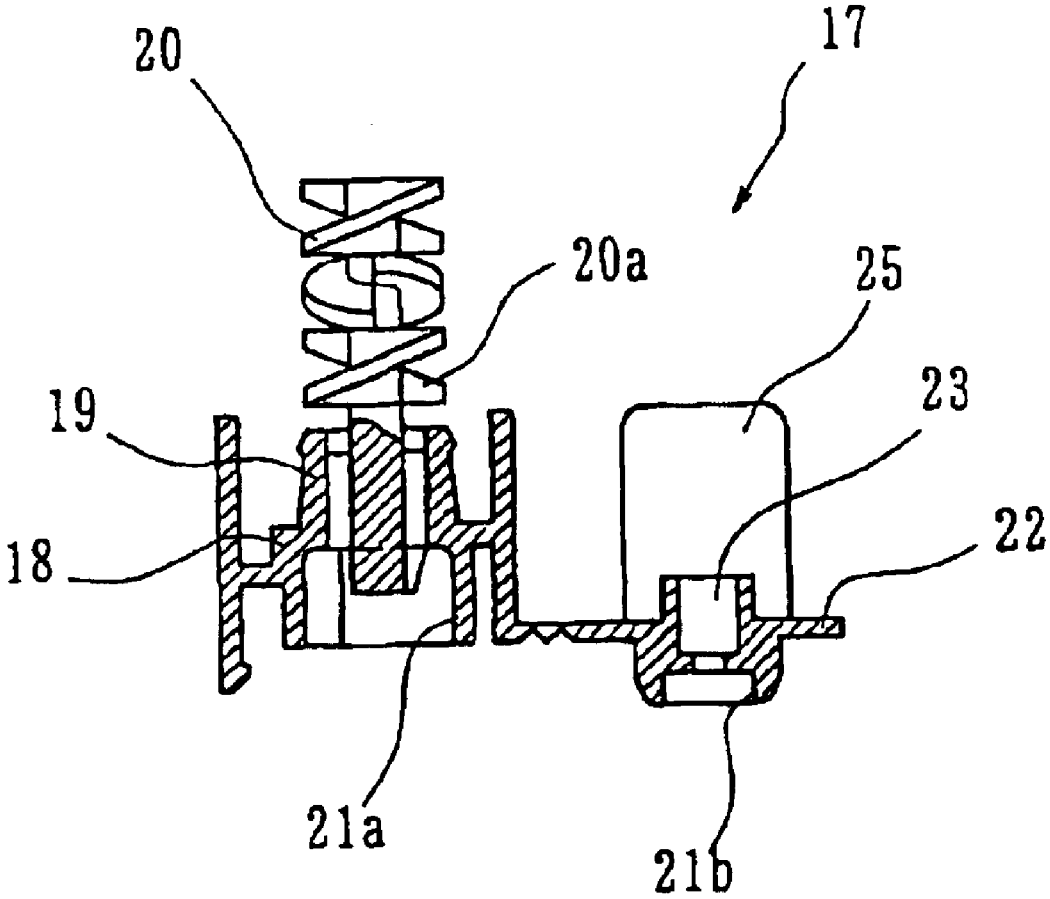
FIG. 18 is a side longitudinal section of the passage block in its open state in the embodiment shown in FIG. 11.
Figure 19:
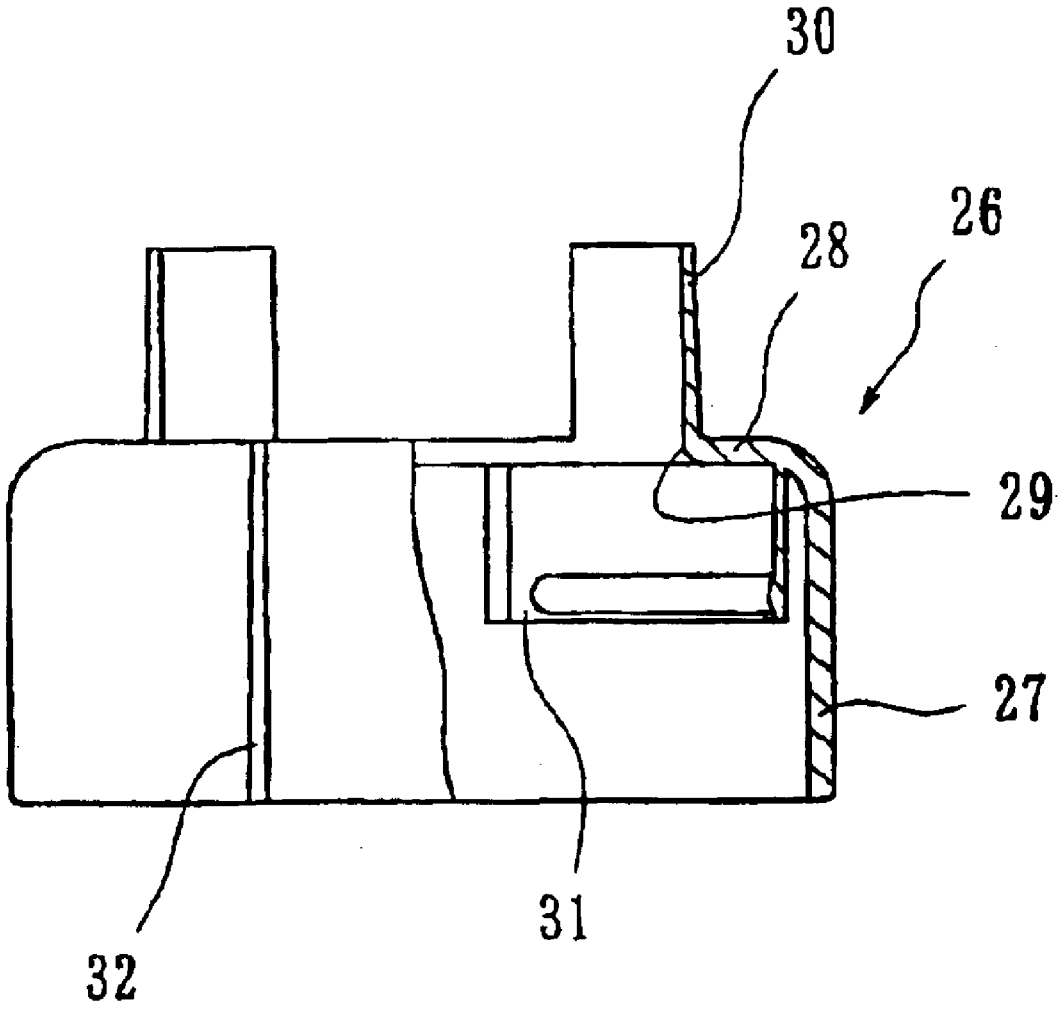
FIG. 19 is a front semi-longitudinal section of the attachment shown in FIG. 11.

As obvious from FIG. 13, the attaching legs 7 of the brush 2 are partly bulged out. It is easy, therefore, to pinch these legs with the thumb and a finger to depress them inward and to remove the brush 2 from the cap unit 8.

Figure 12:
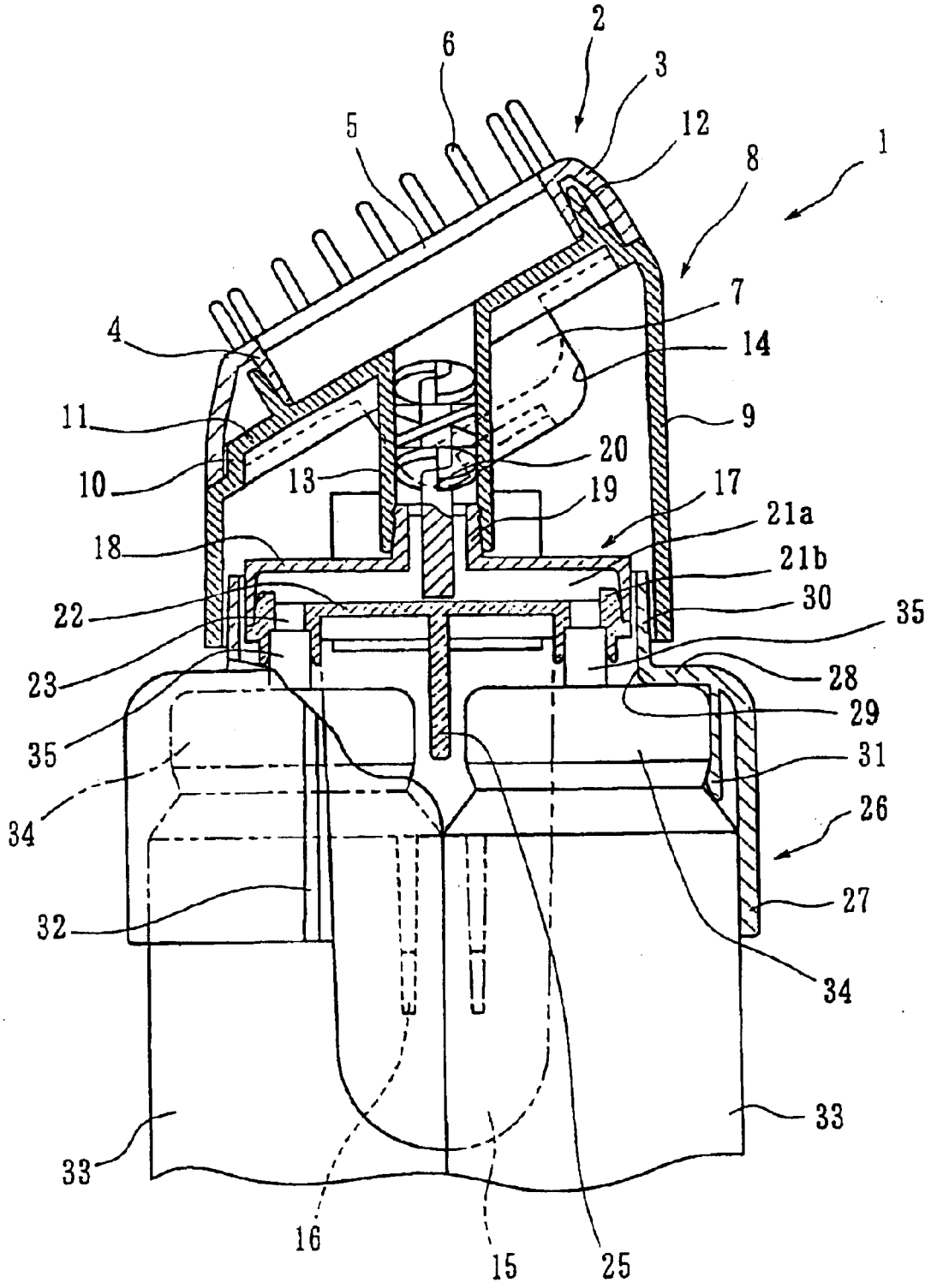
FIG. 12 is a partially drawn, front longitudinal section of the mixing and discharge device shown in FIG. 11.

As obvious from FIG. 12, the brush 2 is inclined downward from the right to the left at an angle of 20–40 degrees, preferably an angle of 30 degrees. This angle makes it easy to put the brush 2 alongside of the target place by holding the containers in a hand and to apply the mixture of contents discharged from among the thin brushing pieces 6 onto the target place, such as hair of the head.

Figure 20:
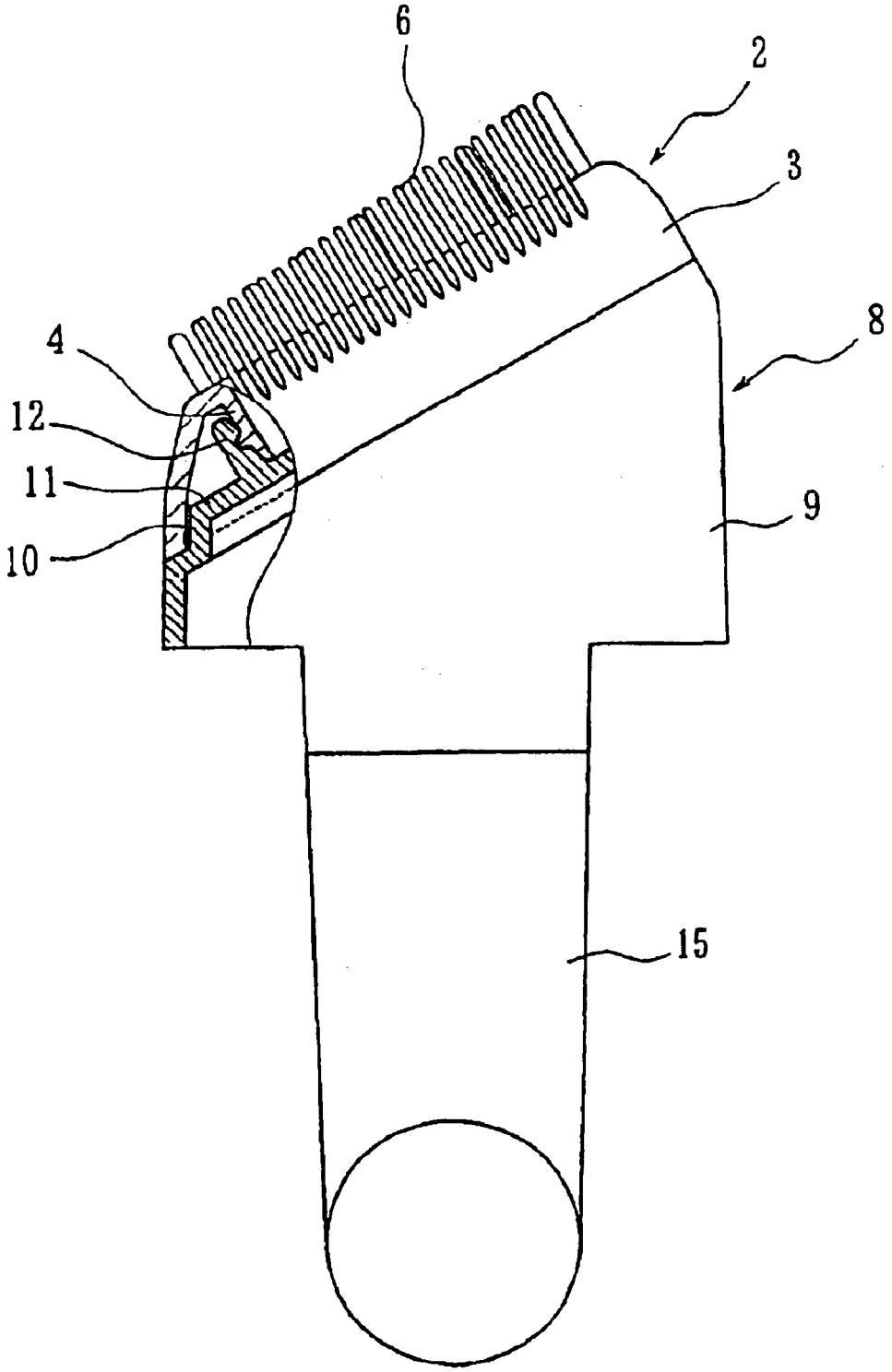
FIG. 20 is a partially broken, front elevational view of the critical section in the eighth embodiment of the invention, showing the cap unit and the brush in their state fitted firmly to each other.

FIG. 20 shows the 8th embodiment of this invention, in which the brush 2 is non-detachably fitted to the cap unit 8. Except for the brush 2 and the cap unit 8, the device of the 8th embodiment is similar to that of the first embodiment.

The brush 2 is non-detachably fitted to the cap unit 8, by fitting the tight-fitting cylindrical wall 4 of the brush 2 into the elliptic fitting guide 12 of the cap unit 8, with the help of the undercut engagement. Therefore, in this 8th embodiment, there is no attaching leg 7 on the brush 2, nor the locking aperture 14 on the cap unit 8, as these portions are the components for achieving a detachable engagement.

Since the brush 2 cannot be removed from the cap unit 8, all the discharge passage components are not exposed. However, the passage components under the cap unit 8 are exposed by removing the cap unit 8 from the attachment 26, and by pulling away the passage block. Since the discharge passage components, such as the vertical passage cylinder 13, the elliptic fitting guide 12, and tight-fitting cylindrical wall 4, have relatively large sizes of simple structures, it is fully possible to clean these components.

However, because strong fitting of the brush onto the cap unit is secured, it is possible to use the brush under the stable condition and to obtain reliable sealing ability. Now that the brush 2 and the cap unit 8 are not removable from each other, the disassembling of other components and the structure of the device are simplified.

Figure 21:
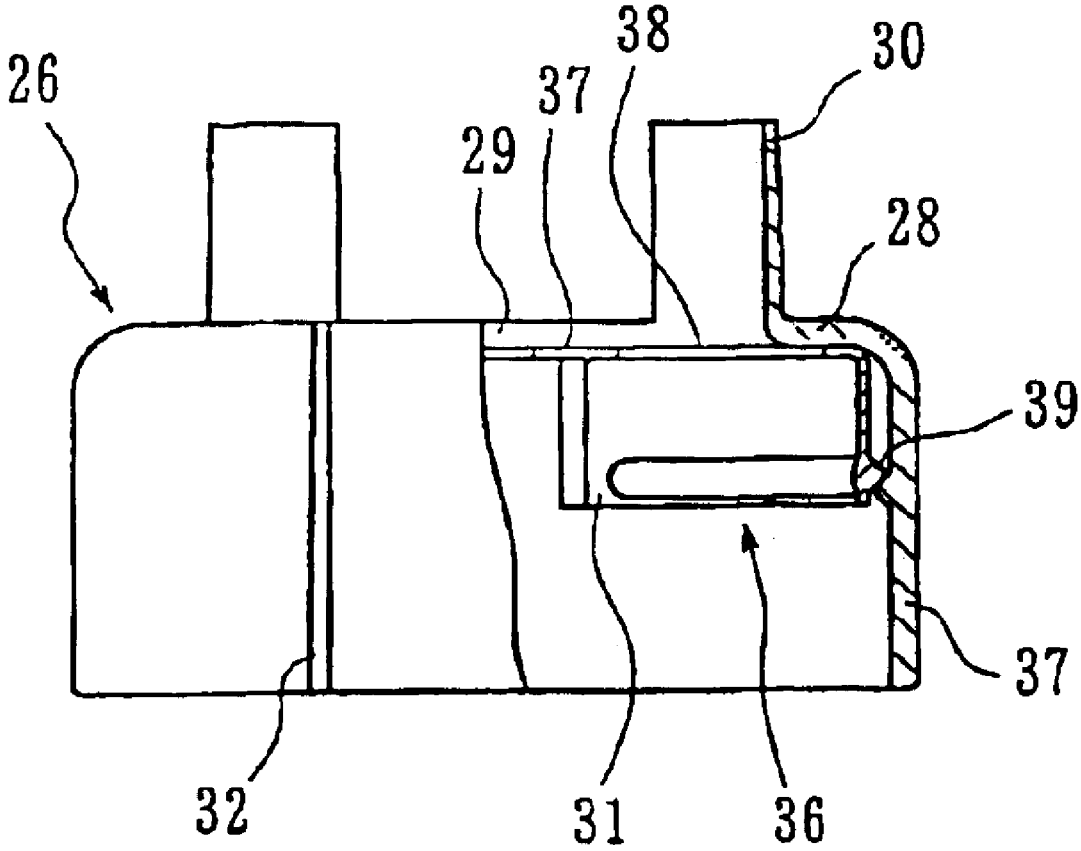
FIG. 21 is a partially broken, front elevational view of the attachment in another embodiment of this invention.
Figure 22:
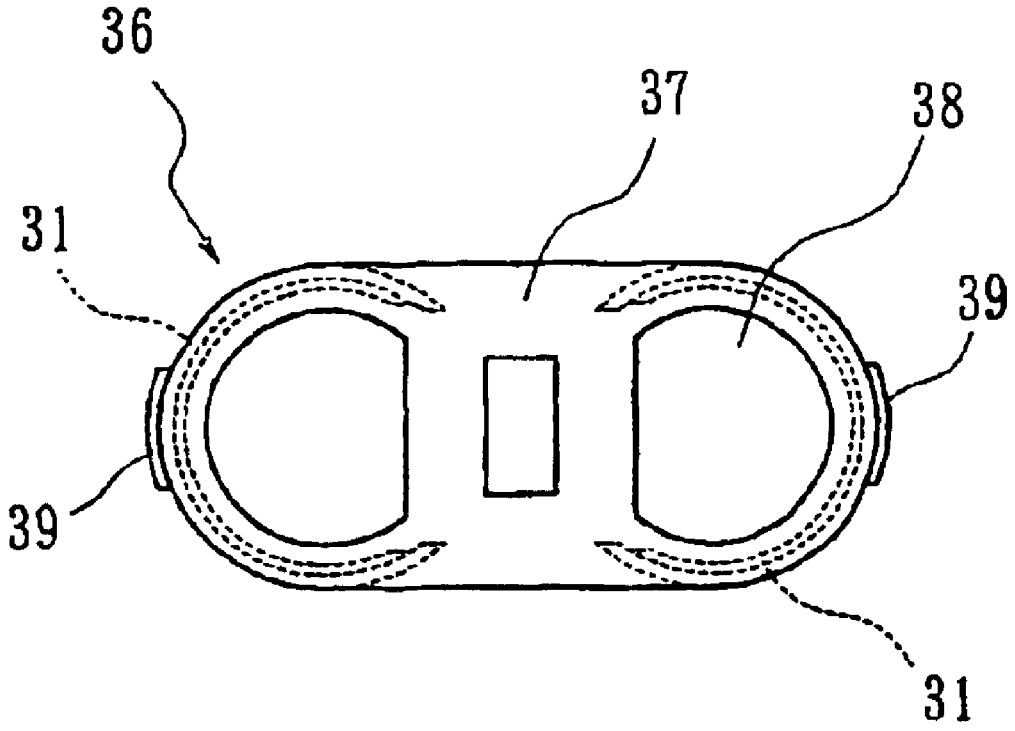
FIG. 22 is a plan view of the connector in the embodiment shown in FIG. 21.

FIGS. 21 and 22 show another structure of the attachment 26, in which the downward fitting guides 31 alone are separated from the main body of the attachment 26. Except for the fitting guides 31, the attachment 26 has no other different structure. The downward fitting guides 31 in this embodiment are disposed on the connector 36, which is connected with the attachment 26 through the undercut engagement.

The connector 36 is provided with a connecting plate 37 of an elliptic shape extending from side to side, from under which the two fitting guides 31 are suspended at both ends of the ellipse. A stop ridge 39 is disposed on the outer wall at each end of the ellipse to enter the undercut engagement with the attachment 26. Inside each fitting guide, the connecting plate 37 has an opening 38, through which the discharge nozzle 35 of each container 33 comes out. At the center of the connecting plate 37, there is an escape slit for passing the tab 25 of the passage block 17.

When this connector 36 is fitted around the heads 34 of the container pair 33, it stably secures the posture of the container pair 33 that stands in the side-by-side position. Before the attachment 26 is fitted around the containers 33, the connector 36 enables a shrink label to be attached to the container pair 33 under a good operating condition.

Figure 23:
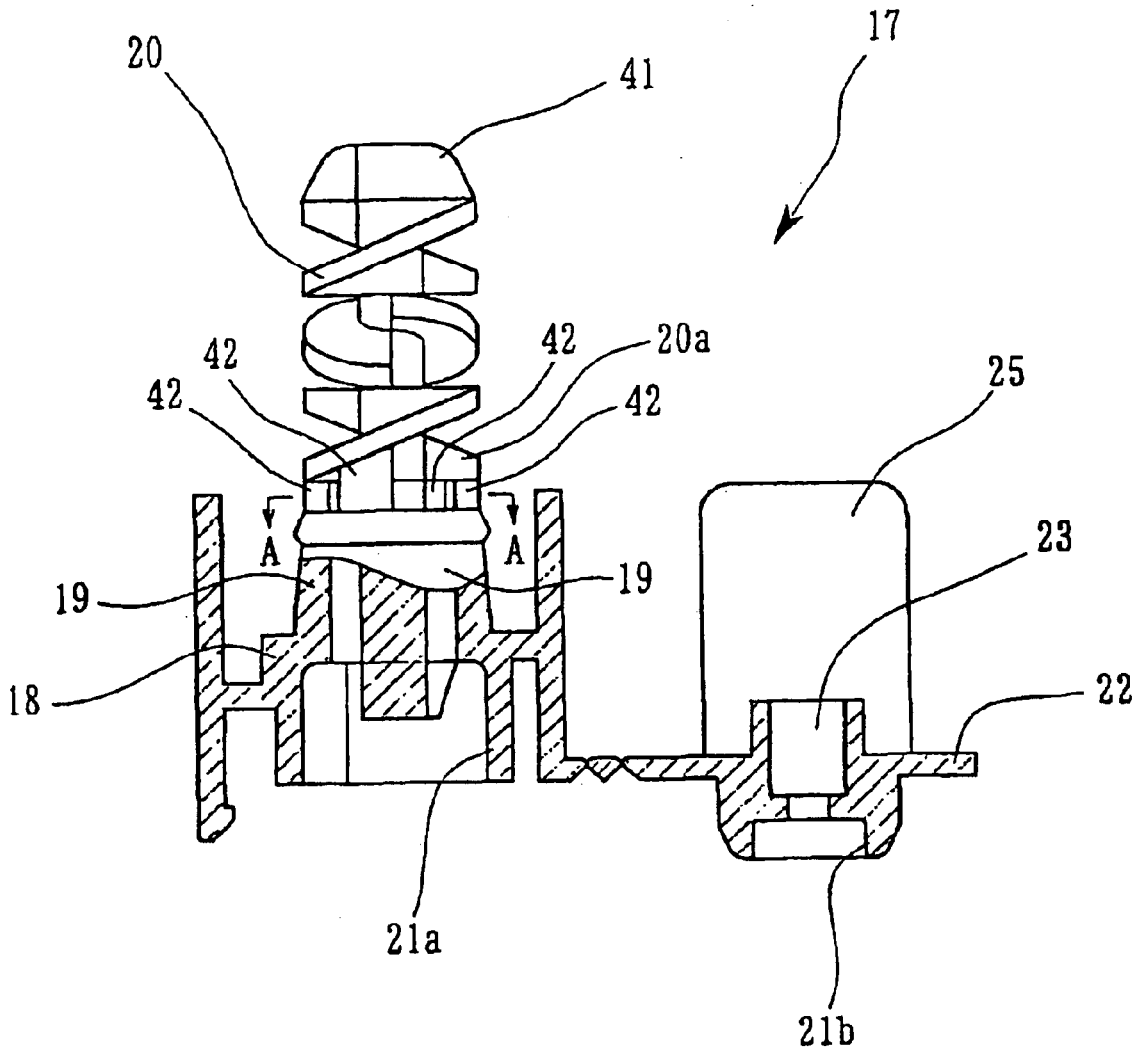
FIG. 23 is a partially drawn, side longitudinal section of the passage block in its open state in another embodiment.
Figure 24:
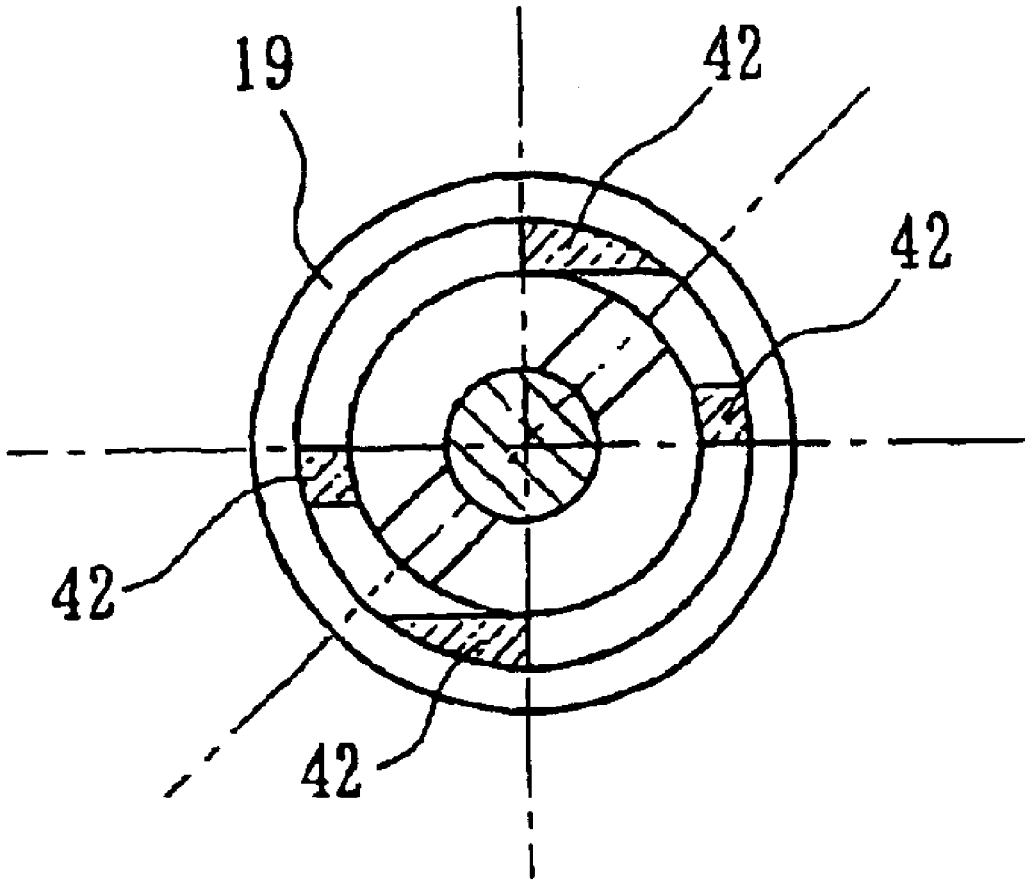
FIG. 24 is a cross-sectional plan view of the passage block in another embodiment, taken from the line A—A of FIG. 23.

FIGS. 23 and 24 show another structural embodiment of the passage block 17. The mixing rod 20 is provided with a blunt-headed tip 41. Four reinforcing ribs 42 are disposed at positions of a roughly isometric angle on the mouth of the discharge cylinder 19, where the ribs do not block the fluid flow path. These ribs 42 are connected to the lowermost blade 20*a* of the mixing rod 20. For other components, the device of this embodiment is similar to that of the 7th embodiment.

When the passage block 17 is fitted to the cap unit 8, the blunt-headed tip 41 makes it easy for the mixing rod 20 to be inserted smoothly into the vertical passage cylinder 13. The tip in this shape also helps preventing the mixing rod 20 from being deformed or broken, for example, when a blade 20*a* is accidentally hooked on the lower end of the vertical passage cylinder 13.

When the passage block 17 is fitted to, or removed from, the cap unit 8, unintentional force may be applied to the mixing rod 20, such as the mixing rod happens to get hooked on another member. At such a time, stress is concentrated on the portion of the lower end of upright mixing rod. The reinforcing ribs 42 wind down the concentration of this stress, and prevent the mixing rod 20 from being broken.

This invention having the above-described configurations shows the following effectiveness:

In an embodiment of the invention, the mixing and discharge device has the configuration that the discharge nozzles are pressed down by the force that pulls down the cap unit. There is no change in the posture of the passage block relative to the discharge nozzles when the contents are discharged. The pair of discharge nozzles are depressed right downward, and the seal between the step holes and the discharge nozzles is secured reliably.

Since both discharge nozzles are opened simultaneously, uniform volumes of contents are ejected from both containers. The user can use the mixing and discharge device of this invention always under suitable conditions.

An actuating mechanism of a simple structure can be formed by means of the edges of contact and the descendible projections disposed on the manipulating plates. The lateral depressive operation of the manipulating plates is reliably converted to the upward or downward movement of the manipulating plates by the action of the guide slopes.

The attachment and the cap unit are easily assembled with the container pair by mere fitting. Thus, the assembled device has a simple structure.

The cap unit is detachably fitted to the discharge nozzles. When in washing after use, the cap unit can be easily removed, if necessary, from the discharge nozzles or from the attachment.

In an embodiment of the invention, the passage block can be stably moved up- or downward by allowing the guide slits to be slidably moved up or down through these guide slits.

In an embodiment of the invention, it is possible to secure sufficient sealing ability even at a high pressure and to provide a mixing and discharge device of the aerosol type that can achieve the uniform mixing of the contents when they come out of both containers.

In an embodiment of the invention, the lower edge of the elliptic cylinder of the attachment is used as the edge of contact. The manipulating plates are obtained as the extensions to the hanging plates, which sit astride of the elliptic cylinder. This embodiment affords to form the manipulating plates of a simple structure.

The manipulating plates used to open and close the discharge nozzles are positioned near the surfaces of the containers and are not projected outward. There is little chance, therefore, that some object may get hung up on these manipulating plates. In addition, the discharge nozzles cannot be pulled down unless both of the manipulating plates are simultaneously depressed. If one of the manipulating plates is depressed unintentionally, no content is discharged from the containers. This configuration makes it easy to obtain safe handling of the mixing and discharge device.

In an embodiment of the invention, the support plates hold both of the manipulating plates at a stable posture. Even if the discharge device is sandwiched between other objects, these objects bump against the support plates, which protect the manipulating plates so as not to be depressed simultaneously. In this way, any accidental discharge of the contents can be prevented effectively.

In an embodiment of the invention, the device comprises the step latches that climb over the lower edges of support plates and click into place, thus ensuring to prevent the cap unit from coming off unintentionally.

In an embodiment of the invention, a clicking sound is emitted due to the elastic recovery deformation when the step latches have climbed over the edges of the support plates and clicked into place. This mechanism provides a mixing and discharge device having high handling ability and safety, so that the device can be used reliably.

In an embodiment of the invention, the guide slope can be contacted with the edge of contact at a position spaced from the outer wall of the elliptic cylinder. This means that when the manipulating plates are depressed, it is possible to take a large width of displacement and therefore to have a large distance for which the discharge nozzles are pulled down. Thus, it also becomes easy to use the discharge device of a pumping type, which requires a relatively large depressive length.

In an embodiment of the invention, the manipulating plates are connected to the elliptic cylinder. In this configuration, the cap unit is pulled down by the depressing operation of the manipulating plates. Since the containers are not uplifted, the discharge operation is stably carried out.

In an embodiment of the invention, the cap unit is prevented from coming off unintentionally due to the stopping engagement between the locking part and the edge of contact.

In an embodiment of the invention, a clicking sound is emitted due to the elastic recovery deformation when the step latches have climbed over the edges of the support plates and clicked into place. It has become possible, therefore, to provide a mixing and discharge device that has high handling ability and safety and can be used reliably.

In an embodiment of the invention, the device has the configuration that the contents ejected from a pair of containers are mixed and discharged to the brush fitted to the cap unit. The mixed content can be applied onto hair in a simple operation.

In an embodiment of the invention, among the brush, the cap unit, and the passage block, which constitute the three components of the applicator used to form the passages for discharging the contents, at least the passage block can be separated from other components. Since the complex paths of flow inside the passage block are exposed, the contents remaining inside can be readily and fully washed away from the passages, and the device can be used repeatedly for the application of contents under the favorable condition.

Concerning the brush and the cap unit, it is possible to choose the fitting type between detachable engagement and non-detachable one, depending on the purpose. The remaining content can be washed away from the combination of the brush and the cap unit after the cap unit has been removed from the attachment, and the passage block, from the cap unit.

In an embodiment of the invention in which the brush and the cap unit have a detachable configuration, a high washing effect is achieved, and the remaining content can be easily and fully washed away.

In another embodiment of the invention, the brush cannot be separated from the cap unit. The combination of the brush and the cap unit does not expose all the discharge passage components, but since the combination is structurally simple, it is quite possible to wash away the remaining content fully from the discharge passages. Because strong fitting of the brush onto the cap unit is secured, it is also possible to use the brush under the stable condition and to obtain reliable sealing ability. Now that the brush and the operating unit are not removable from each other, the disassembling of other components and the structure of the device are simplified.

In an embodiment of the invention, the depressive force coming from the cap unit is acted on the discharge nozzles via the passage block. It becomes possible for the contents to be ejected from aerosol containers, simply by applying relatively small force while controlling the discharge volumes.

In an embodiment of the invention, the mixing rod is provided with a blunt-headed tip. The tip in such a shape allows the components to be fitted smoothly, and prevents the mixing rod from being broken.

In an embodiment of the invention, the mixing rod is provided with reinforcing ribs, which prevent the rod from being broken.

What is claimed is:

1. A mixing and discharge device comprising:

a pair of containers (33) standing next to each other and respectively provided with a discharge nozzle (35) having an open/close function;

an attachment (26), which is fitted firmly around the top portions of said containers (33) and which comprises an elliptic cylinder (27) to be fitted tightly around the top portions of the bodies of said pair of containers (33), a top inward brim (28) disposed on the top edge of the elliptic cylinder (27), and an opening (29) from which the discharge nozzles (35) come out; and a cap unit (8) to be fitted detachably to the discharge nozzles (35) and provided with a passage block (17), which comprises a pair of step holes (23) disposed in the areas near both sides, and into which the discharge nozzles (35) are fitted tightly from underside, a discharge cylinder (19) disposed at the center and on top of this unit (8) to form a discharge port, and discharge passages (21) for connecting this discharge port with the step holes (23);

wherein said mixing and discharge device also comprises: a pair of hanging plates (51) that comes out of the central, front and rear portions of the passage block (17) and hangs down on the front and rear walls of the elliptic cylinder (27); a pair of manipulating plates (55) extending from the lower end of either one of said hanging plates (51) or the elliptic cylinder (27); descendible projections (16), which are provided respectively with a guide slope **(16*a*) and disposed on the manipulating plates (55) at positions opposite to valley-shaped portions that are formed in abutment with the bodies of said pair of containers (33), with the tip of the guide slope (16*a*) being set at a height under the lower end of said elliptic cylinder (27); and a pair of edges of contact (57) disposed at the other one of the hanging plates (51) or the elliptic cylinder (27) at positions opposite to said guide slopes (16*a*), and wherein a force to pull down the cap unit (8) is actuated by depressing said manipulating plates (55) in the lateral direction and sliding said guide slopes (16*a*) over the edges of contact (57)**.

2. The mixing and discharge device, according to claim 1, wherein semicircular connecting guides (30) are standing upright from the edge of the top inner brim (28) of the elliptic cylinder (27), and wherein guide slits **(17*a*) are opened in a part of the passage block (17), and into which the upward semicircular connecting guides (30) are fitted in a manner that said guides (30) can be slidably moved upward or downward through these guide slits (17*a*)**.

3. The mixing and discharge device according to claim 1, wherein the containers (33) are aerosol containers.

4. The mixing and discharge device according to claim 1, which comprises:

manipulating plates (55) disposed respectively under the hanging plates (51) as the extensions thereto;

the edge of contact (57) to be used being the lower edge of contact **(57*a*), which is a part of the lower edge of the elliptic cylinder (27); and a pair of descendible projections (16) disposed at positions on the inner surfaces of the manipulating plates (55), facing the lower edge of contact (57*a*), each of said projections having a guide slope (16*a*) inclined downward so as to come in sliding contact with the lower edge of contact (57*a*), wherein said guide slope (16*a*) extends upward from the level of contact with the lower edge of contact (57*a*) up to a height at least enough to be able to open the discharge nozzles (35), under the condition that the cap unit (8) remains upheld by the discharge nozzles (35)**.

5. The mixing and discharge device according to claim 4, wherein each of the front and rear surfaces of the elliptic cylinder (27) is provided with a pair of support plates (32) at the vertical positions on both sides of, and close to, the hanging plate (51) and the manipulating plate (55), and is projected laterally at a height larger than those of the outer surfaces of the hanging plate (51) and the manipulating plate (55).

6. The mixing and discharge device according to claim 5, wherein step latches **(55*a*) are formed on both sides of each manipulating plate (55) by expanding the width of the manipulating plate at the lower part thereof, and are clicked into place when the latches have climbed over the lower edges of the support plates (32)**.

7. The mixing and discharge device according to claim 6, wherein a clicking sound is emitted due to the elastic recovery deformation when the step latches **(55*a*) have climbed over the edges of the support plates (32)** and clicked into place.

8. The mixing and discharge device according to claim 1, which comprises:

a window-like opening (60) cut in both hanging plates (51) in the area ranging from the height of almost the central part to the lower end of each hanging plate (51);

a manipulating plate (55) disposed in the extended portion of each hanging plate (51), which extends upward from the lower end via the fold at the bottom;

a pair of outward brims (58) extending from the lower edge of the elliptic cylinder (27) at its central, front and rear portions;

the edge of contact (57) to be used being the lower edge of contact (57*c*), which is a part of the lower edge of the outward brim (58); and a descendible projection (16) disposed on the inner surface of each manipulating plate (55), at the position in which the lower edge of contact (57*c*) on the outward brim (58) faces the opening (60) in the hanging plate (51), each projection having a guide slope (16*a*) inclined downward so as to come in sliding contact with the lower edge of contact (57*c*), with said guide slope (16*a*) extending upward from the level of contact with the lower edge of contact (57*c*) on the outward brim (58) up to a height at least enough to be able to open the discharge nozzles (35), under the condition that the cap unit (8) remains upheld by the discharge nozzles (35) after the containers (33), the attachment (26), and the cap unit (8) have been assembled.

9. The discharge device according to claim 1, which comprises:

a pair of extended plates (56) having a window-like opening (62) and reaching the fold at the bottom by extending the lower edges of the central, front and rear portions of the elliptic cylinder (27);

a pair of manipulating plates (55) extending upward from the lower edges of the extended plates (56) via the fold at the bottom;

a pair of banging plates (51), each having a window-like opening (61) disposed at the height of the roughly central portion;

the edge of contact (57) to be used being the upper edge of contact (57*b*), which is a part of the entire bottom side of this opening (61), said upper edge of contact (57*b*) on the bottom side being located at the position facing the opening (62) in the extended plate, and the lower portion of said hanging plate (51) being sandwiched between the extended plate (56) and the manipulating plate (55); and a descendible projection (16) disposed at positions on the inner surface of each manipulating plate (55), said projection facing the upper edge of contact (57*b*) and having a guide slope (16*a*) inclined upward so as to come in sliding contact with the upper edge of contact (57*b*) on the bottom side of the window, with said guide slope (16*a*) extending downward from the level of contact with the upper edge of contact (57*b*) on the bottom side down to a depth at least enough to be able to open the discharge nozzles (35), under the condition that the cap unit (8) remains upheld by the discharge nozzles (35) after the containers (33), the attachment (26), and the cap unit (8) have been assembled.

10. The mixing and discharge device according to claim 1, wherein the descendible projection (16) on the manipulating plate (55) is provided with a locking part (59) that allows itself to be caught by the edge of contact (57).

11. The mixing and discharge device according to claim 10, wherein a clicking sound is emitted due to the elastic recovery deformation caused when the locking part (59) slips into the underside of the edge of contact (57) and is caught into place.

12. The mixing and discharge device according to claim 1, wherein said device comprises a brush (2), which is provided with many thin brushing pieces (6) and is fitted to the cap unit (8), and wherein the contents from a pair of containers (33) are mixed and sent to the brush (2), where the contents are discharged to the top surface of said brush (2) from inside thereof.

13. The mixing and discharge device according to claim 12, which comprises:

a passage block (17) to be fitted detachably to the cap unit (8) and comprising a main block body (18) and a bottom plate (22); said main block body (18) having a discharge cylinder (19) disposed on top of the central portion thereof, through which a mixing rod (20) stands upright, and having a passage wall (21 a) formed underneath said main block body (18) to open a downward space; and said bottom plate (22) being connected to the rear, lower edge of said main block body (18) by a hinge, and provided with a pair of step holes (23), into which the discharge nozzles (35) are fitted tightly, projected passage members (21*b*) tightly fitted from underside into the passage wall (21*a*) to form discharge passages (21), and a tab (25) hanging from the central portion of the bottom plate (22);

a cap unit (8) comprising a main operating cylinder (9) of an elliptic shape, a top plate (11) connected to the top portion of the main operating cylinder (9), an elliptic fitting guide (12) that stands upright from the inward brim of the top plate (11), and a vertical passage cylinder (13) hanging from the center of the top plate (11) and having an exit to the inner area surrounded by the elliptic fitting guide (12), said cap unit (8) allowing the mixing rod (20) to be inserted into the vertical passage cylinder (13) thereof and also allowing the discharge cylinder (19) to be tightly fitted into the vertical passage cylinder (13) to assemble the passage block (17) into the main operating cylinder (9) detachably; and a brush (2) to be fitted to the cap unit and comprising a dome attachment (3) covering the top plate (11), a tight-fitting cylindrical wall (4), which is disposed inside the dome attachment (3) and is fitted tightly into the elliptic fitting guide (12), a slit-like discharge port (5) that connects the dome space within the tight-fitting cylindrical wall (4) to the outside of this brush (2), and many thin brushing pieces (6) disposed standing around the discharge port (5) on the top plate of the dome attachment (3).

14. The mixing and discharge device according to claim 13, wherein the brush (2) is detachably fitted onto the cap unit (8).

15. The mixing and discharge device according to claim 13, wherein the brush (2) is non-detachably fitted onto the cap unit (8).

16. The mixing and discharge device according to claim 13, wherein the containers (33) are aerosol containers.

17. The mixing and discharge device according to claim 13, wherein the mixing rod (20) has a tip of a blunt-headed shape.

18. The mixing and discharge device according to claim 13, wherein reinforcing ribs (42) are prepared to reinforce the lower end of the upright mixing rod (20), and are disposed on the mouth of the discharge cylinder (19) at positions where the ribs do not block the fluid flow path.

* * * * *

UNITED STATES PATENT AND TRADEMARK OFFICE

CERTIFICATE OF CORRECTION

PATENT NO. : 6,834,778 B2
DATED : December 28, 2004
INVENTOR(S) : Keiji Jinbo et al.

It is certified that error appears in the above-identified patent and that said Letters Patent is hereby corrected as shown below:

Column 11,
Line 8, change “dges” to -- edges --.

Column 13,
Line 60, change “fined” to -- fitted --.

Column 21,
Line 28, change “banging” to -- hanging --.

Column 22,
Line 12, change “(21 a)” to -- (21*a*) --.

Signed and Sealed this

Twelfth Day of July, 2005

JON W. DUDAS
*Director of the United States Patent and Trademark Office*